US007104564B2

(12) United States Patent
Martin et al.

(10) Patent No.: US 7,104,564 B2
(45) Date of Patent: Sep. 12, 2006

(54) BACKWARDS RELEASE SKI BINDING

(76) Inventors: Ralph M. Martin, 340 Cottonwood Ct., Longmont, CO (US) 80501; Terry E. O'Connell, 15527 Huron St., Broomfield, CO (US) 80020; Scott M. Nathanson, 6702 S. Leyden Ct., Englewood, CO (US) 80112

( * ) Notice: Subject to any disclaimer, the term of this patent is extended or adjusted under 35 U.S.C. 154(b) by 0 days.

(21) Appl. No.: 10/336,564

(22) Filed: Jan. 3, 2003

(65) Prior Publication Data

US 2005/0167950 A1 Aug. 4, 2005

Related U.S. Application Data

(63) Continuation-in-part of application No. 09/748,970, filed on Dec. 27, 2000, now Pat. No. 6,769,711.

(60) Provisional application No. 60/224,312, filed on Aug. 10, 2000.

(51) Int. Cl.
*A63C 9/18* (2006.01)

(52) U.S. Cl. ..... 280/625

(58) Field of Classification Search ..... 280/612, 280/613, 618, 620, 623, 625, 634, 819, 11.213, 280/14.21, 14.23

See application file for complete search history.

(56) References Cited

U.S. PATENT DOCUMENTS

| | | | |
|---|---|---|---|
| 2,559,020 | A | 7/1951 | Lehmkuhl |
| 2,616,714 | A | 11/1952 | Cubberley |
| 3,386,748 | A | 6/1968 | Eie |
| 3,504,922 | A | 4/1970 | Wiley |
| 3,612,559 | A | 10/1971 | Petersen et al. |
| 3,730,543 | A | 5/1973 | Edmund |
| 3,787,868 | A | 1/1974 | Camp |
| 3,866,929 | A | 2/1975 | Lacroix |
| 3,870,326 | A | 3/1975 | Cubberley |
| 3,874,685 | A | 4/1975 | von Besser |
| 3,942,810 | A | 3/1976 | Salomon |
| 3,961,802 | A | 6/1976 | Vannatter |
| 3,976,308 | A | 8/1976 | Napflin |
| 4,003,587 | A | 1/1977 | Salomon |

(Continued)

FOREIGN PATENT DOCUMENTS

AT 304329 * 1/1971

(Continued)

OTHER PUBLICATIONS

English Language translation of the German reference to Camp (DE 24 02 684).*

(Continued)

*Primary Examiner*—Frank Vanaman
(74) *Attorney, Agent, or Firm*—Rick Martin; Patent Law Offices of Rick Martin, PC

(57) ABSTRACT

A sliding plate supports a heel (or toe or both) binding member on a ski. By depressing a remote switch the skier activates a linear actuator on the ski, thereby releasing a latch which allows a stored energy source to force a rear lock arm assembly to pivot upward. By the pivoting upward of the central pivot joint between the forward and rear lock arms, the overall length of the lock arm assembly is reduced. The sliding plate is attached to one end of the lock arm assembly. Thus, when the lock arm assembly is remotely actuated into the release mode, and shortened, the sliding plate pulls its ski binding member and increases the distance between the ski binding members, thereby releasing the boot from the ski binding members even in a backward fall. Other spring activated embodiments include a piston release assembly.

12 Claims, 26 Drawing Sheets

U.S. PATENT DOCUMENTS

| | | | | |
|---|---|---|---|---|
| 4,023,824 | A | | 5/1977 | von Besser |
| 4,033,604 | A | | 7/1977 | Cirino |
| 4,058,326 | A | | 11/1977 | Faulin |
| 4,109,932 | A | | 8/1978 | With |
| 4,129,245 | A | | 12/1978 | Bonvallet |
| 4,135,735 | A | | 1/1979 | Beyl |
| 4,239,257 | A | | 12/1980 | Biermann et al. |
| 4,322,090 | A | | 3/1982 | Loughney |
| 4,324,409 | A | | 4/1982 | Larsen et al. |
| 4,418,937 | A | | 12/1983 | Salomon |
| 4,512,594 | A | | 4/1985 | Eyre |
| 4,533,156 | A | | 8/1985 | Gertsch |
| 4,545,598 | A | * | 10/1985 | Spitaler et al. ..... 280/612 |
| 4,572,541 | A | | 2/1986 | Bernard et al. |
| 5,052,710 | A | | 10/1991 | Provence et al. |
| 5,066,036 | A | | 11/1991 | Broughton |
| 5,085,453 | A | | 2/1992 | Bildner |
| 5,328,201 | A | | 7/1994 | Wladar |
| 5,364,118 | A | | 11/1994 | Burger et al. |
| 5,383,365 | A | | 1/1995 | Edmund |
| 5,501,483 | A | | 3/1996 | Stepanek et al. |
| 6,196,570 | B1 | | 3/2001 | Klubitschko |
| 6,206,404 | B1 | | 3/2001 | Buquet et al. |
| 6,390,493 | B1 | | 5/2002 | Hauglin |

FOREIGN PATENT DOCUMENTS

| | | | |
|---|---|---|---|
| CH | 467081 | * | 2/1969 |
| DE | 2356415 | * | 5/1974 |
| DE | 2402684 | * | 7/1975 |
| EP | 0 336 782 | * | 11/1989 |

OTHER PUBLICATIONS

International Preliminary Examining Authority, Written opinion PCT/US01/24954, Jan. 26, 2005, Brian Johnson.

* cited by examiner

BACKWARDS RELEASE SKI BINDING

CROSS-REFERENCE TO RELATED APPLICATION

The present application is a continuation in part claiming priority to provisional U.S. application No. 60/224,312 filed Aug. 10, 2000, non-provisional application Ser. No. 09/748,970, filed Dec. 27, 2000 which issued as U.S. Pat. No. 6,769,711 on Aug. 3, 2004.

FIELD OF THE INVENTION

The present invention relates to automatically via a ski pole transmitter releasing ski bindings by pushing a button on the ski pole bindings or another transmitter button remote from the ski bindings.

BACKGROUND OF THE INVENTION

It is estimated that over 10,000 crippling knee injuries occur each ski season in Colorado, U.S.A., alone. Extrapolating worldwide there might be over 50,000 knee injuries each ski season worldwide. Great advances have been made in downhill ski bindings to automatically release during violent forward falls. Several problems exist with the best downhill ski bindings.

A serious problem is the slow, twisting backward fall. Most anterior crucia ligament (ACL) injuries occur with this type of fall. Expert skiers teaching children fall during a lesson and tear their ACL. A damaged ACL can be treated with a modern, complex, and expensive surgery called a patella tendon graft replacement for the ACL. Other body parts such as the hamstring tendon can also be used to replace the damaged ACL.

Thus, two surgeries are required. First a body part such as the patella tendon is harvested. Second the damaged ACL is removed and replaced with the harvested body part.

A good result requires six months of the replacement ACL to gain strength and function like the original ACL. About a year's physical therapy is required to regain maximum use of the leg. Two wounds must heel, without infection. Stiffness in the knee joint sometimes leads to loss of full range of motion. Atrophy of the leg muscles from the down time of surgery adds stress to the already weakened knee. Additional ACL and related injuries do occur. An average cost of one procedure with therapy is about $15,000.00.

All this misery can stem from one careless fall backwards while standing in the ski line. Following your child at 3 mph can lead to a slow backwards fall and a crippling ACL injury. Nobody has invented a working solution to this one worst injury so frequently caused by a careless moment on downhill skis.

One new attempt to solve this problem is the Lange® boot rearward pivot ankle segment of the boot. A pre-set backward force will release the ankle segment of the boot rearward. However, the boot is still locked into the ski binding. Only twelve pounds of twisting torque on the foot is required to tear an ACL. The Lange® boot solution does not address the release of rotational force on the knee. It addresses the release of a rearward force by the boot on the back of the skier's calf. It is unknown if this system will reduce ACL injuries.

A large portion (perhaps half) of all ACL injuries occur at slow speeds falling backwards. Therefore, a couple of seconds of reaction time exists for a trained skier (either novice or expert) to push an emergency release button on his ski pole handle and totally eject from his skis. By the time the skier hits the ground, he's out of his skis without exerting any rotational torque to his knees. Properly trained skiers using the present invention can reduce the risk of ACL injury by a large percent, perhaps even half. This could mean 25,000 fewer worldwide ACL injuries a year, and a much safer sport overall.

Other uses for this emergency release system (also called a bail out™ system) include easy release for beginners so they can spend less time learning to stand up, and more time skiing. Upside down skiers in a tree hole can quickly release and quickly get out of a dangerous situation.

The basic principle of the present invention is to mount the heel and/or toe release segment of a ski binding on a short track. Pushing the release button energizes a stored force on the ski to move the heel and/or toe binding along the track to a position larger than the ski boot. The result is a size 10 boot in a size 12 binding. The skier is instantly free of his skis.

To remount the skier resets his binding to the loaded and properly sized position, steps in, and skis as usual.

SUMMARY OF THE INVENTION

The main aspect of the present invention is to provide a track on a ski binding element, wherein a remote release button powers the ski binding element to move on the track to a position larger than the skier's proper boot and binding locked position.

Another aspect of the present invention is to provide a transmitter button on a ski pole to activate the movement of the ski binding on the track.

Another aspect of the present invention is to provide a spring having an electronically activated release mechanism on the ski to move the binding element on the track.

Another aspect of the present invention is to provide a gas actuated piston on the ski to move the ski binding element on the track.

Another aspect of the present invention is to provide a mounting plate with a track to house a toe and heel element of a ski binding.

One embodiment uses the stored energy of a spring in a housing mounted to the rear of a ski binding heel element. A radio signal activated mechanism releases the spring which moves the ski binding heel element back along a track to very rapidly release a skier from his binding.

All normal functions of a modern, forward release ski binding remain intact.

Initial prototypes prove the concept of building a track style release mechanism which can use off the shelf ski bindings.

Future models of the track style release binding could be factory built with the initial ski binding.

A sliding plate supports a heel binding member on a ski. By depressing a remote switch the skier activates a linear actuator on the ski, thereby releasing a latch which allows a stored energy source to pivot a central joint upward, the preferred embodiment. By the central pivot joint between the forward and rear lock arms pivoting upward, the overall length of the lock arm assembly is reduced. The sliding plate is attached to one end of the lock arm assembly. Thus, when the lock arm assembly is actuated into the release mode, and shortened, the sliding plate pulls its ski binding member and increases the distance between the ski binding members, thereby releasing the boot from the ski binding members even in a backward fall. Either a spring or gas piston assembly is used as the stored energy source to pivot the lock arm assembly upward to the release mode. Either a base plate supports all the elements of the sliding plate assembly, or a rail member is fastened directly to the ski upon which the sliding plate slides. This rail embodiment offers the least weight added to the ski. The invention can be adapted for use on most prior art downhill ski bindings. All the prior art release functions of the prior art step in release bindings are unchanged, but additionally the skier can cock his system with a simple step onto the lock arm assembly central pivot joint, and push a button on his pole to release even in a slow backward fall.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
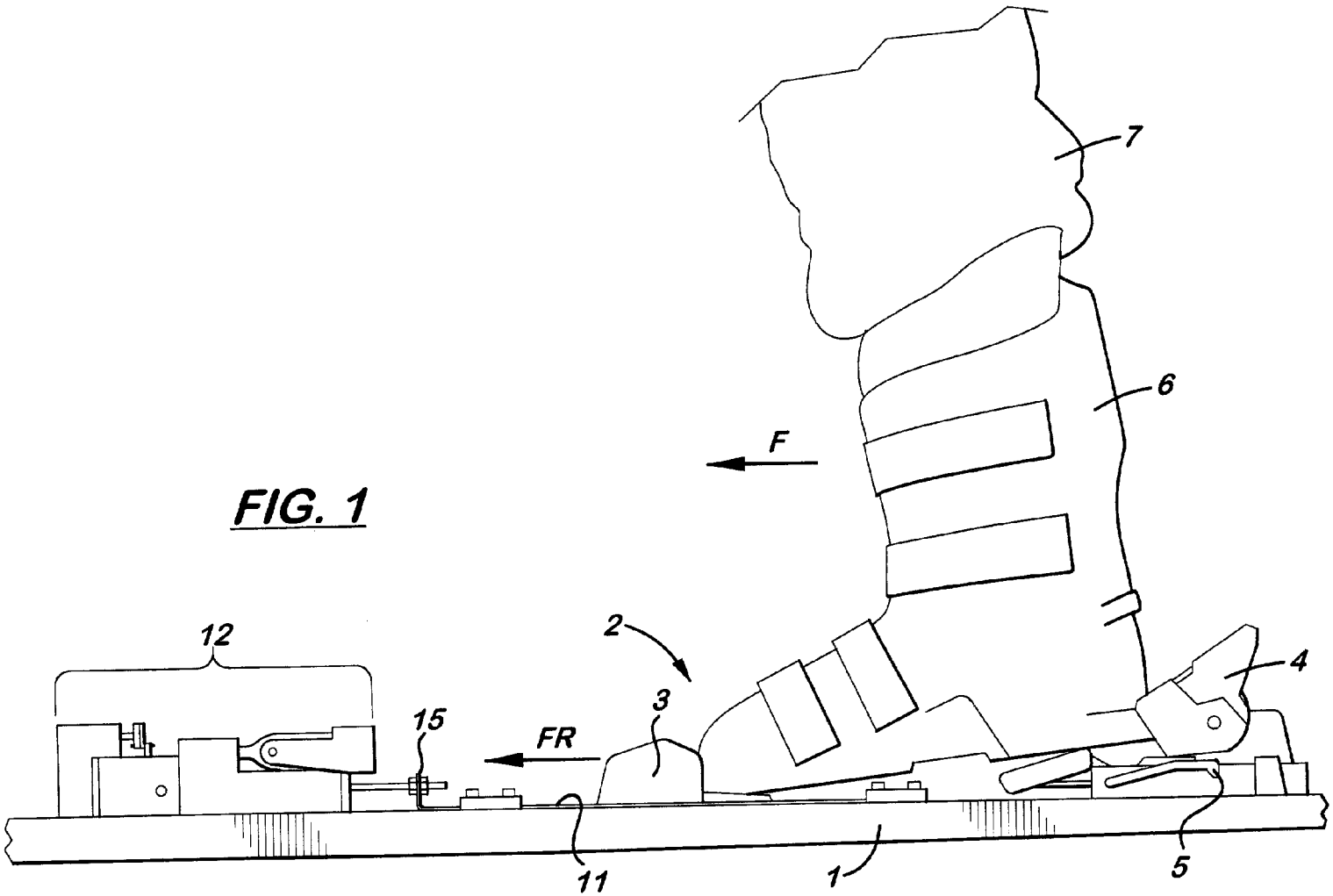
FIG. 1 is a right side plan view of a toe piece track release embodiment.

Referring first to FIG. 1 a downhill ski 1 has a traditional forward release binding system 2 comprising a toe release mechanism 3, a heel release mechanism 4 and a snow brake 5. When the skier 7 falls forward his boot 6 moves forward in direction F thereby releasing the binding system 2 in a known manner. Upon release the snow brake 5 is thrust downward. A movable track 11 supports the toe release mechanism 3. An actuator arm 15 is connected to the track 11. Any one of a variety of actuating mechanisms 12 respond to a remote signal to pull the track 11 forward in direction FR, thereby releasing the boot 6 from the binding system 2.

Figure 3:
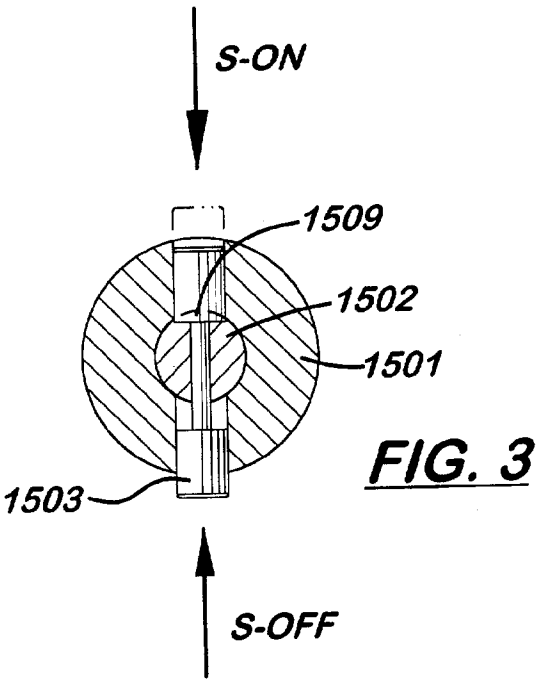
FIG. 3 is a cross sectional view taken along line 16—16 of FIG. 2.
Figure 2:
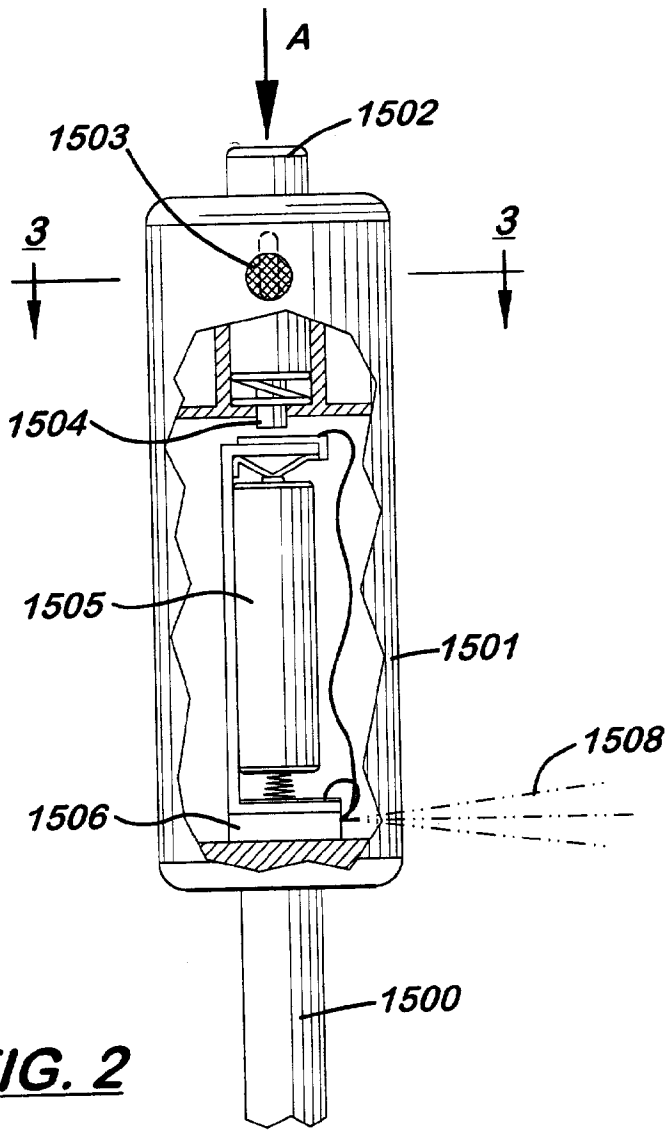
FIG. 2 is a partial cutaway view of the ski pole handle transmitter.

Referring next to FIGS. 2, 3 the ski pole 1500 has a handle 1501. An activator button 1502 is mounted on top of the handle for thumb activation. Accidental discharges are prevented by safety switch 1503. The safety on S-ON position prevents the depressing of button 1502 because segment 1509 inserts into a hole in button 1503, locking it. In the safety off position S-OFF the button 1502 is free to be activated. Normally the skier would move to the S-OFF position only during a ski run, not on the lift or during transport.

For release the button 1502 closes switch 1504. The battery 1505 energizes the transmitter 1506 which sends signals 1508 to the ski mounted receiver. Known multiple frequency methods are used to create a large number of different frequencies in the field so as to prevent one skier releasing another's bindings. Short range transmitters also minimize this risk.

Figure 4:
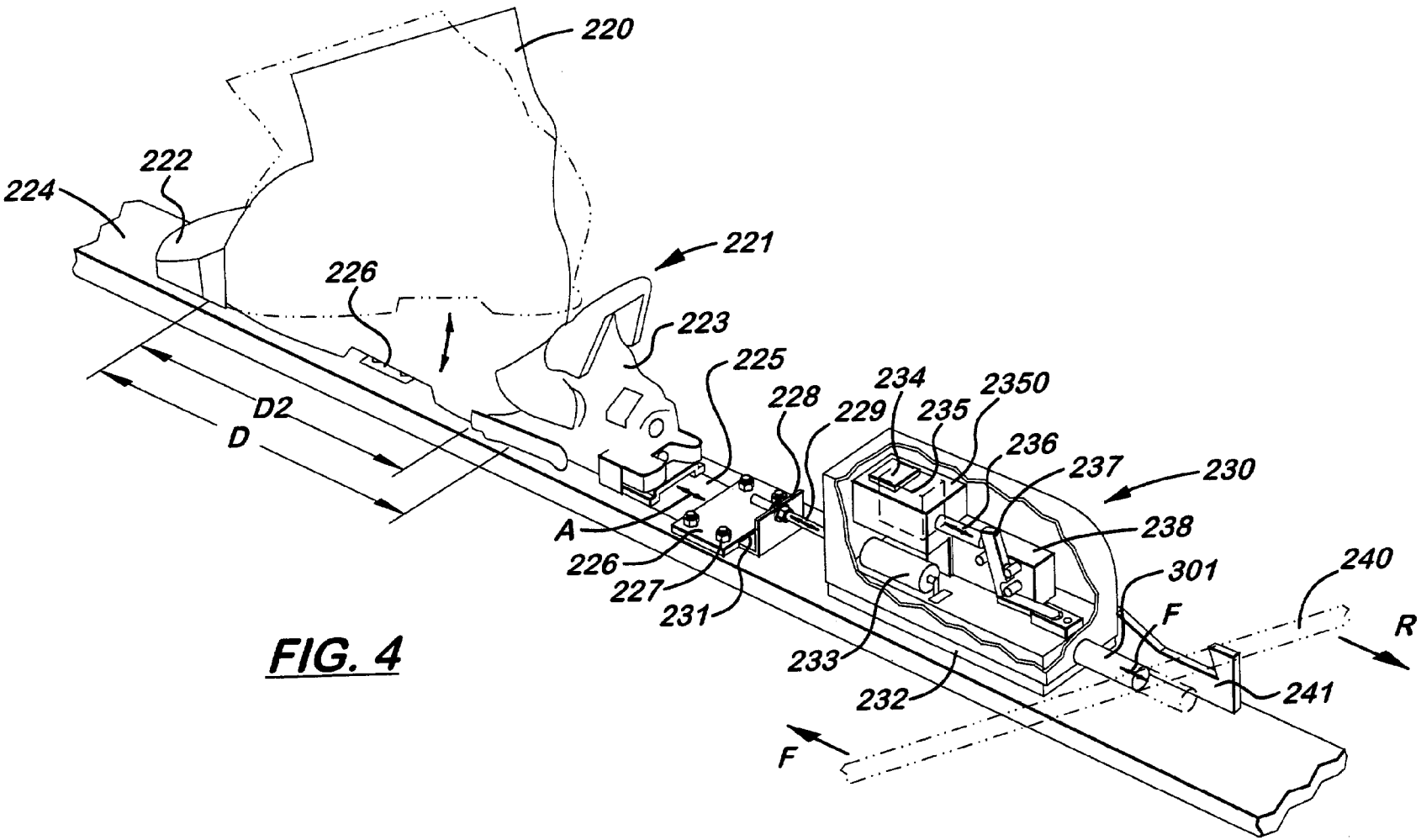
FIG. 4 is a top perspective view of an alternate embodiment spring release mechanism.

Referring next to FIG. 4 a ski boot 220 is shown stepping into a prior art downhill ski binding 221 which consists of a toe piece 222 and a heel piece 223. The dotted lines of the ski boot 220 show the traditional downward movement of the ski boot 220 for locking into the ski binding 221. The toe piece 222 is screwed into the ski 224 in a known manner. The proper mounting distance between the toe piece and heel piece for boot 220 is shown as $D_2$ (distance for skiing).

The heel piece is mounted to the track 225 instead of the ski 224. The track 225 can be a flat metal strip which slides under anchors 226 which are fastened to the ski with screws (or bolts) 227. A notch 231 under the anchors 226 receives the moveable track 225. When the spring release mechanism 230 pulls the track rearward for a release, (shown by arrow A) then the distance between the toe and heel pieces increases to D (distance for release).

Figure 11:
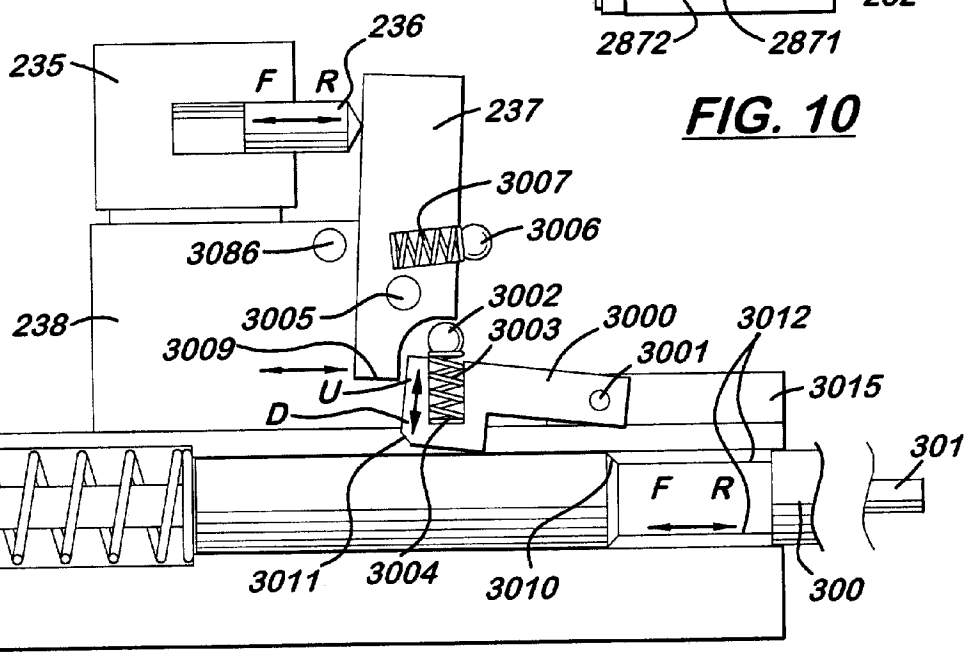
FIG. 11 is a longitudinal sectional view of the spring housing (released) of the FIG. 4 embodiment taken along line 24—24 of FIG. 9.
Figure 9:
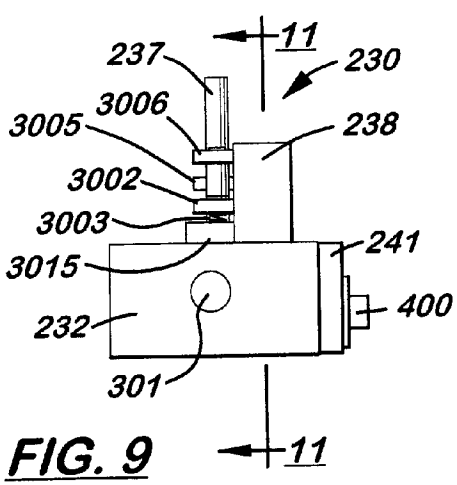
FIG. 9 is a rear plan view of the FIG. 4 embodiment.
Figure 12:
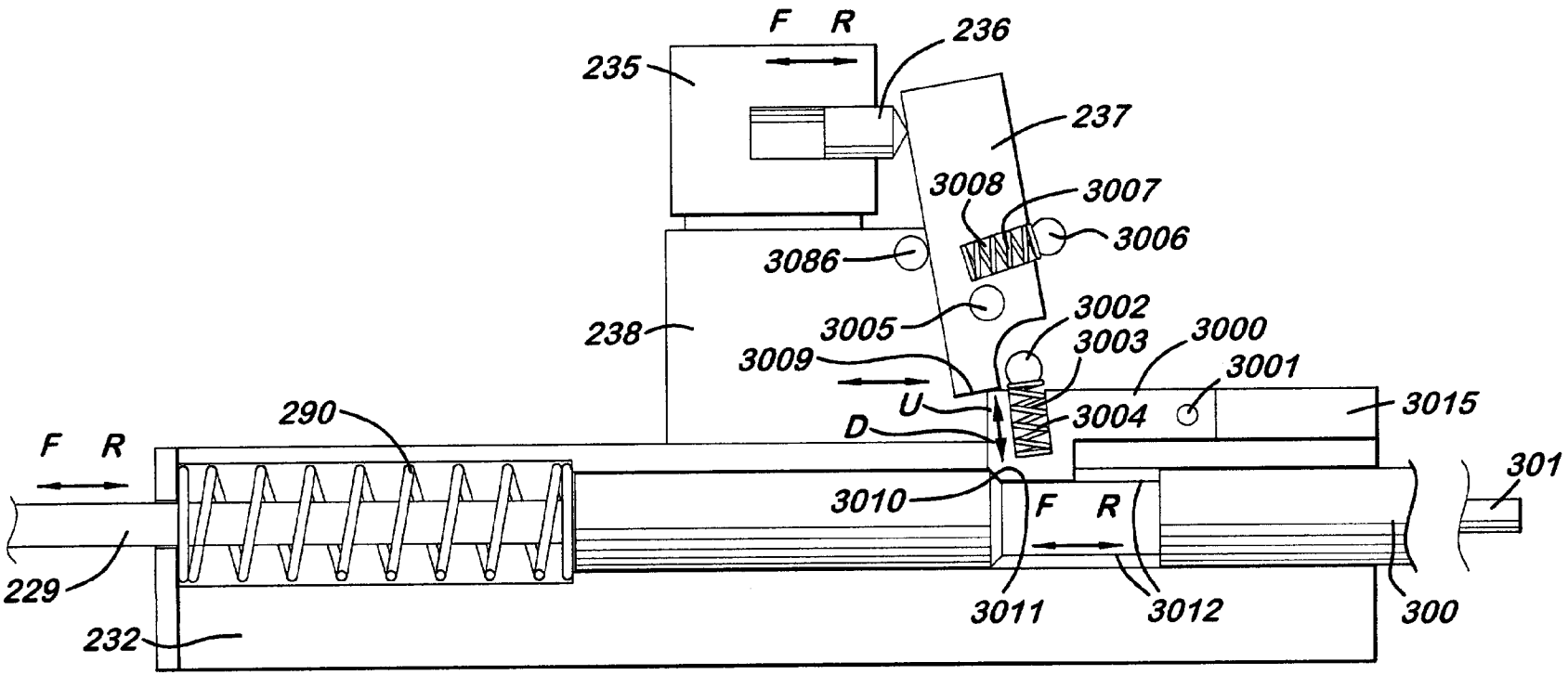
FIG. 12 is a same view as FIG. 11 with the spring housing locked.

The track 225 has a rear flange 228 which is connected to a shaft 229, which in turn is directly attached to a central piston (FIG. 12, 300). The spring release mechanism consists of a main housing 232, a receiver 234, a solenoid 235, an electronics housing 2350, a plunger 236, a trigger 237, and a trigger support 238. In operation a skier cocks the spring release mechanism to the ski position shown in FIG. 12. A lever 240 (such as the tip of a ski pole) is used to push the central piston crank arm 301 forward in direction F. This is accomplished by pulling the lever 240 rearward in direction R against the fulcrum 241. The fulcrum 241 is shown as a simple piece of metal extending rearward from the main housing 232. Now the traditional ski binding 221 functions in the traditional manner to release upon a forward force from the ski boot 220. However, as shown in FIGS. 2, 3 a signal 1508 (preferably a radio signal) is generated by a skier to demand the instant release of his bindings. The receiver 234 receives the signal 1508 and activates the solenoid 235 to extend the plunger 236, thereby tripping the trigger 237. When the trigger 237 is tripped, the stored energy of the main spring (FIG. 11, 290) forces the central piston (FIG. 11, 300) to the release position as shown in FIG. 11. The track 225 is pulled rearward in direction R, and the distance between the toe and heel pieces increases to distance D. In prototype mode the difference between D2 and D is approximately one inch.

Figure 5:
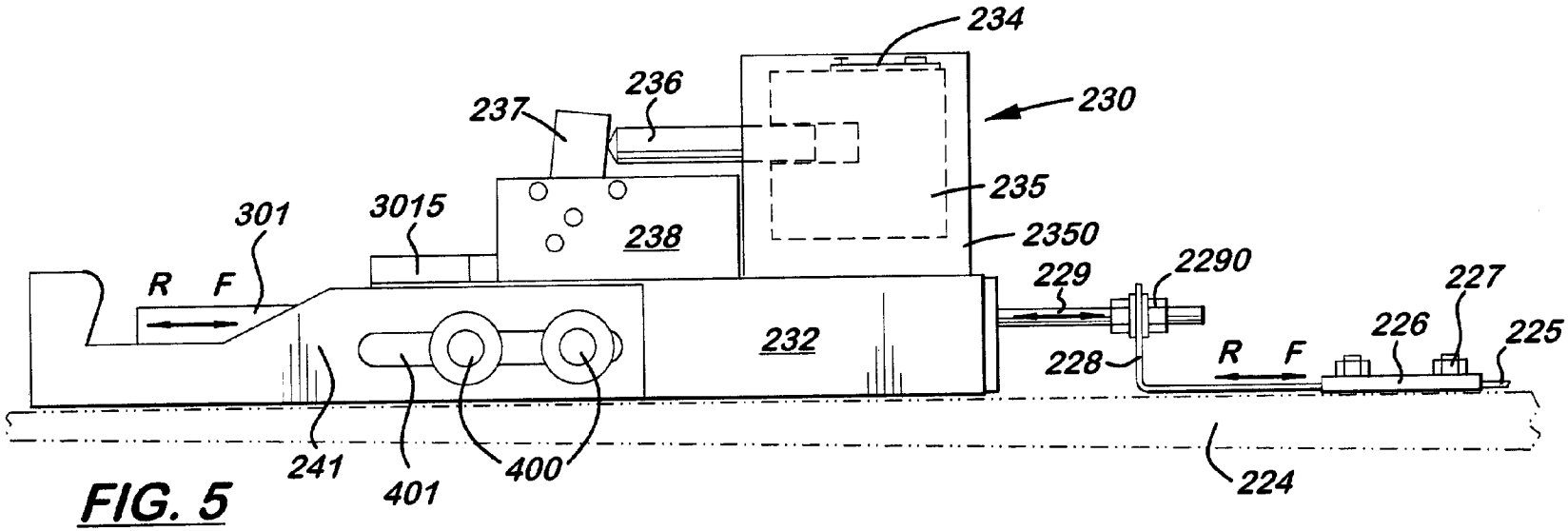
FIG. 5 is a left side plan view of the FIG. 4 embodiment.
Figure 6:
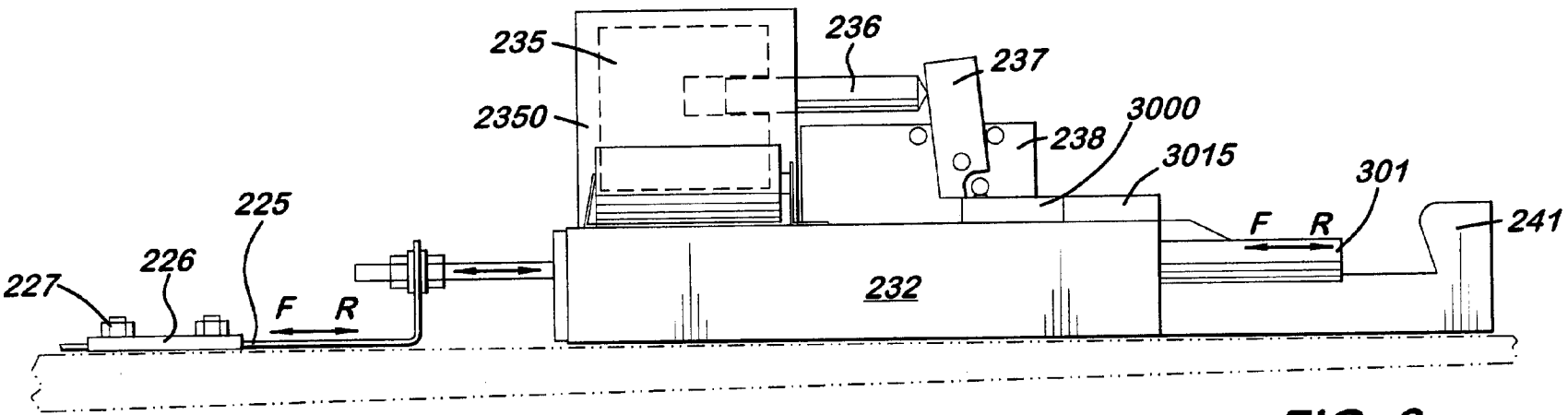
FIG. 6 is a right side view of the FIG. 4 embodiment.
Figure 7:
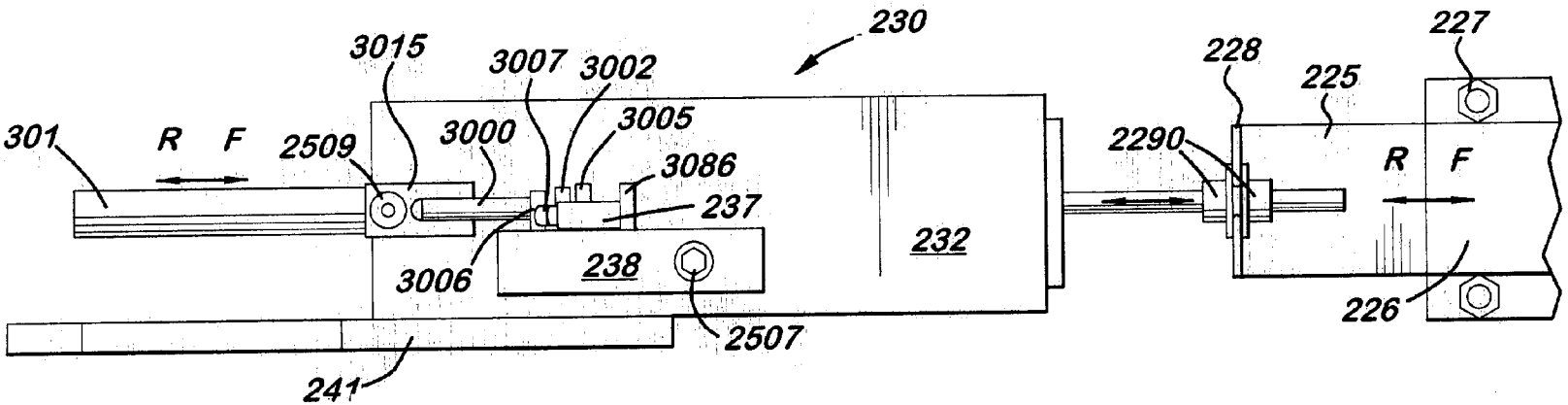
FIG. 7 is a top plan view of the FIG. 4 embodiment.
Figure 8:
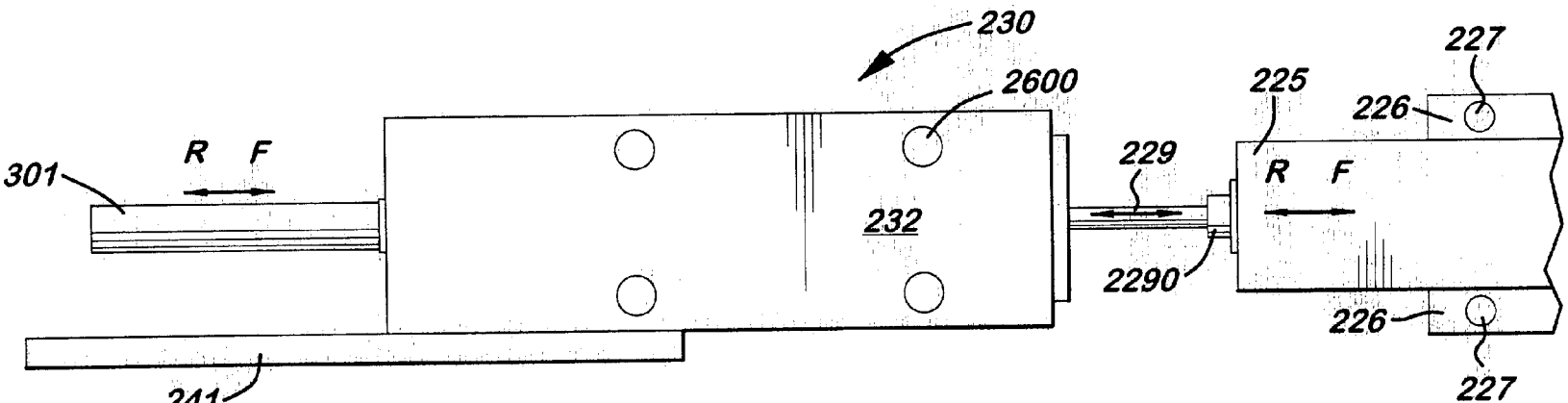
FIG. 8 is a bottom plan view of the FIG. 4 embodiment.
Figure 10:
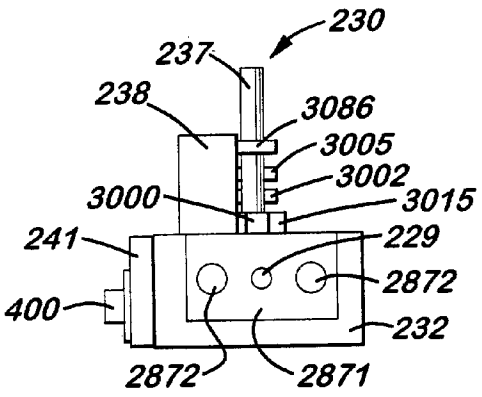
FIG. 10 is a front plan view of the spring housing of the FIG. 4 embodiment.

Referring next to FIGS. 5, 6 the external appearance of the trigger 237 and its related functional parts is shown in plan view. The housing 232 forms a base for the fulcrum 241. A slot 401 allows adjustment of the rearward positioning of the fulcrum 241 with bolts 400. The solenoid 235 is mounted inside the electronic housing 2350, said housing 2350 counteracts the electronic force generated to move the plunger 236 rearward to trigger the trigger 237. Bolts 2290 secure the shaft to the flange 228. The trigger 237 controls the movement of a sear (also called a locking pin) 3000. A base 3015 forms a pivot for the sear 3000 to pivot from.

Referring next to FIGS. 7, 8, 9, 10 the solenoid and electronic components have been removed to better show the mechanical parts. The spring housing 232 has mounting holes 2600 on the bottom for attachment to a ski. A bolt 2507 secures the trigger housing 238 to the spring housing 232. A bolt 2509 secures the sear base 3015 to the spring housing 232. Pin 3086 is a forward stop for the trigger 237. Pin 3005 is a pivot for the trigger 237. Pin 3006 is a stop for spring 3007 which pushes the trigger 237 over the sear 3000 in the cocking operation. Pin 3002 is a stop for spring 3003 which pushes the sear 3000 into the groove 3012 which is located on the peripheral surface of central piston 300.

The operation of the spring mechanism 230 is best seen in FIGS. 11, 12. The electronic parts have been removed. The technical challenge is to store enough energy in the spring 290 to violently pull the track 225 rearward on demand to release. The further challenge is to work with the limited power available with a light weight battery pack on board the ski. Too much added weight is not practical for downhill skis. The solution is a sear 3000 which has a locking corner 3011 which is forced into a locking engagement with a locking edge 3010 of the groove 3012 on the outside of the central piston 300. The spring 3003 forces the sear downward in direction D when the spring is fully compressed. This locked and ready to ski mode is shown in FIG. 12. The spring 3007 forces the trigger 237 to lock the sear 3000 down.

When the skier pushes his release button to send a (preferably radio) signal to the receiver 234, the solenoid 235 (or linear motor) is powered, thereby forcing plunger 236 against the trigger 237. The trigger 237 has a pivot pin 3005, and so the plunger 236 moves the locking bottom edge 3009 off the top of the sear 3000, thereby allowing the spring 3003 to raise the sear around its pivot pin 3001. As this occurs the locking surfaces 3010,3011 are released, and the spring 290 violently discharges its stored energy and pushes the track 225 rearward. This rearward force does overcome both the force of the weight of the skier as well as the force of any ice and debris that has collected on the ski. The release mode is shown in FIG. 11. The cavity 3004 in the sear 3000 holds the spring 3003.

Figure 13:
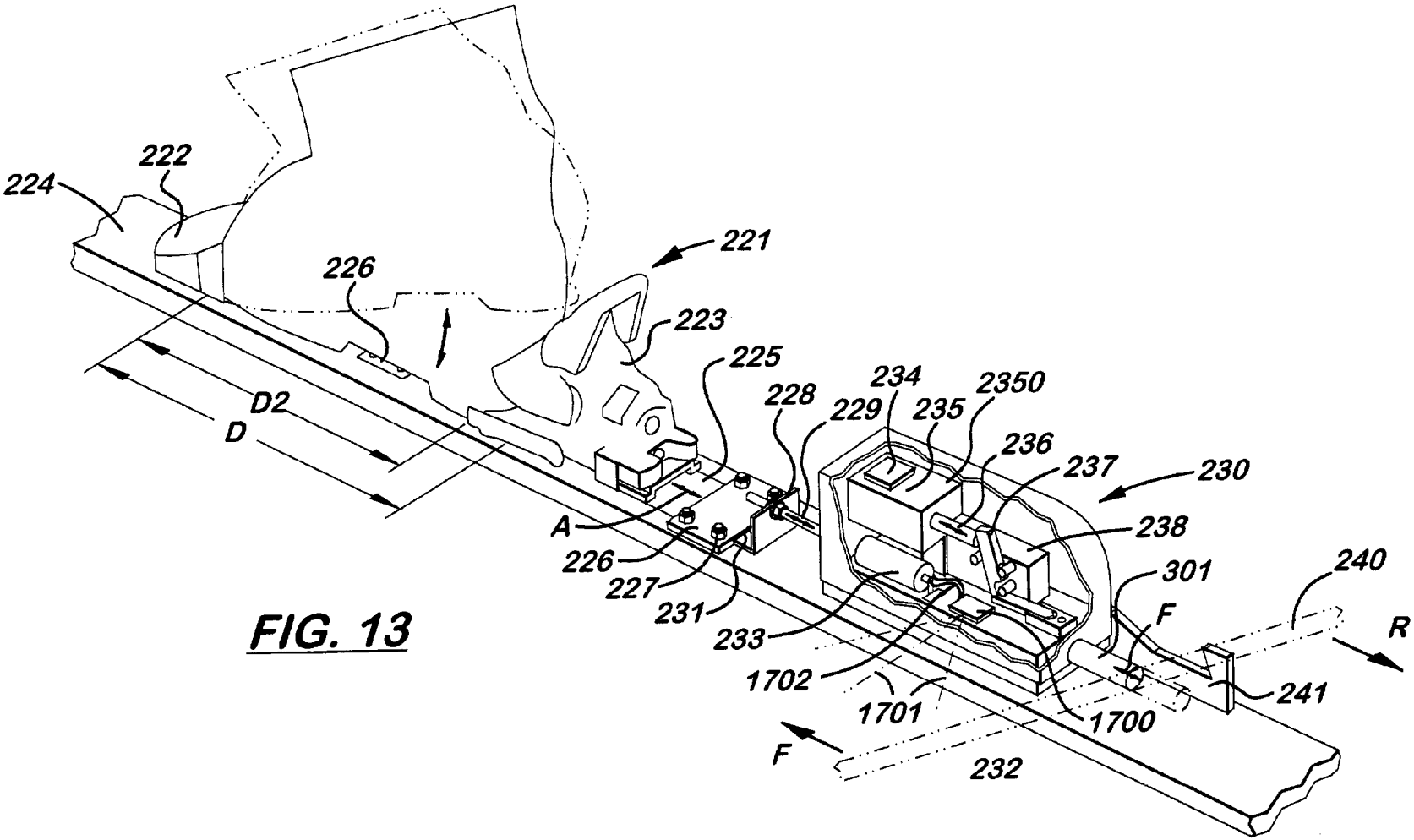
FIG. 13 is the same view as FIG. 4, but the binding housing has an optional sound module, a chirper chip.

Referring next to FIG. 13 the same system as FIG. 4 is shown. However, an optional sound module 1700 is mounted inside the outer case 232. The same battery 233 that powers the solenoid 235 can power the sound module 1700 via wire 1702. Known sound modules include chirper chips used in battery powered fire alarms. A skier who lost his ski in powder (worth perhaps $700.00) can now press his ski pole handle button (FIG. 2, 1502) to make a chirping sound to help locate his ski. The on-board 9 volt battery could also power a mini speaker (not shown) to get more noise.

Figure 14:
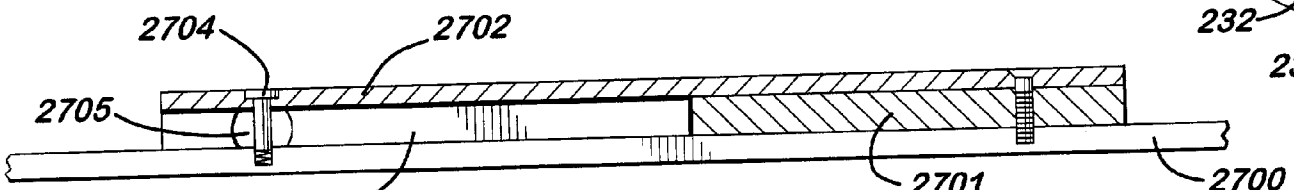
FIG. 14 (PRIOR ART)
FIG. 14 (prior art) is a longitudinal sectional view of a Dynastar® floating heel plate ski.

Referring next to FIG. 14 a prior art Dynastar® Autodrive™ ski 2700 is shown. The idea is to mount the binding onto a flexible plate 2702 in order to get better flex from the ski which now is not compressed by bolts from the binding heel. A flexible cushion layer 2703 supports the heel segment of the metal mounting plate 2702. The toe segment of the binding is supported by a filler layer 2701. As the ski arcs the heel segment of the metal mounting plate floats with support post 2704 moving in cavity 2705.

Figure 15:
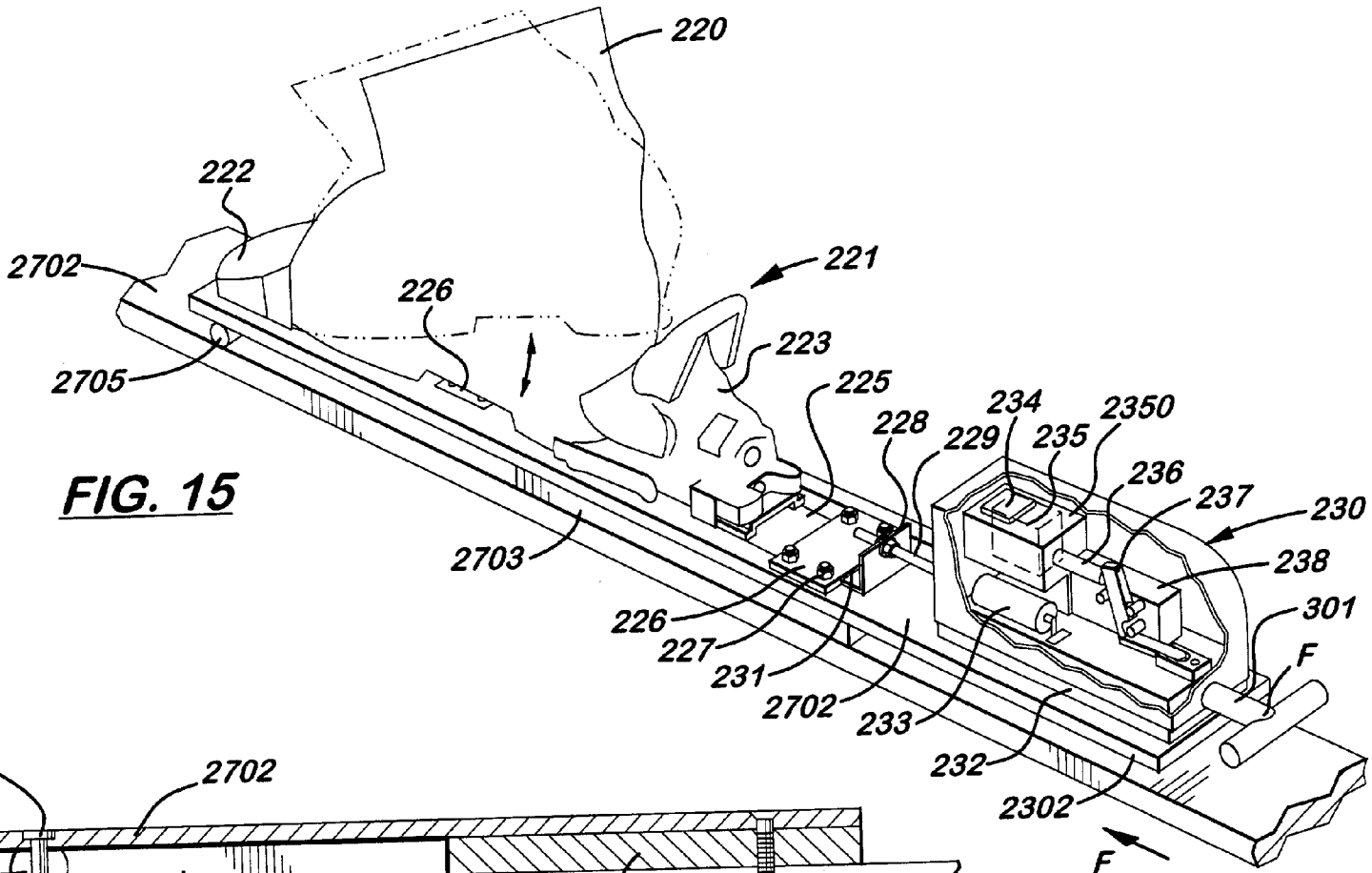
FIG. 15 is a top perspective view of a spring release embodiment mounted on the ski shown in FIG. 14.

FIG. 15 is the same as FIG. 4 except for the use of the ski 2700. The metal mounting plate 2702 holds the entire binding and release assemblies. To cock the spring in the release mechanism 230, the skier can kick or push the plunger 301 impacting a forward force on it.

Figure 16:
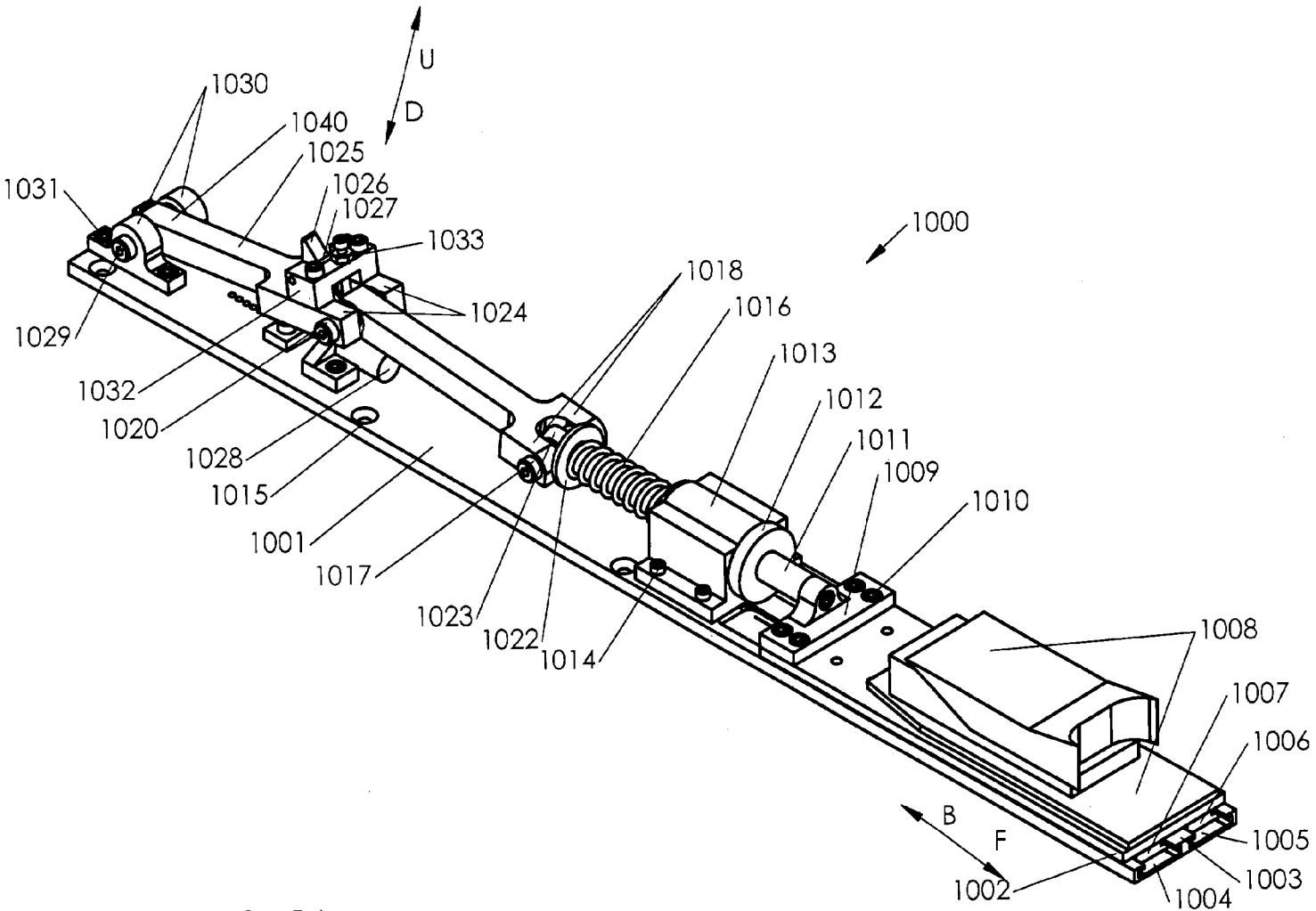
FIG. 16 is a top perspective view of a foot cocking emergency backward release binding, the preferred embodiment, with the actuator cocked and ready to ski.

Referring next to FIG. 16 the emergency backward release binding 1000 has a base plate 1001 with holes 1015 to hold mounting screws to a downhill ski. Other ski types could use the binding 1000 including cross country, monoski, telemark and snowboards. A prior art heel release member of a downhill ski binding 1008 is shown mounted to a track 1002. The track 1002 moves backward B in release mode and locks forward F in the ski mode. The track 1002 has two longitudinal platforms 1007, 1006 which ride in grooves 1004, 1005 respectively. A "T" shaped rail 1003 holds the longitudinal platforms 1007, 1006 down with the top of the T.

The rear of the track 1002 has an anchor 1009 held down with screws 1010. An actuating piston 1011 is fastened to the anchor 1009. An optional soft washer 1012 prevents the anchor 1009 from hitting the guide 1013 in the release mode. Screws 1014 hold the guide 1013 to the base plate 1001. The guide 1013 functions to guide the actuating piston 1011 in a forward F and backward B motion during operation. A spring 1016 pushes from the guide 1013 against the end 1018 of the forward locking arm 1019. A washer 1022 may be used to reduce wear. The end 1018 has a Y shape, wherein the inside of the Y receives the rear end 1023 of the actuating piston 1011. The end 1023 has a hole which receives a pivot pin 1017.

The rear end 1021 of the forward locking arm 1019 is received by the Y shaped forward end of the rear locking arm 1025. The rear end of the forward locking arm 1019 has a hole which receives a pivot pin 1020. The rear end 1040 of the rear locking arm 1025 has a hole which receives pivot pin 1029 which is fastened to rear anchor 1030. The rear anchor 1030 is fastened to the base plate 1001 with screws 1031.

The ski position is shown, wherein the forward end of the rear locking arm 1025 is held down D by the latch 1026 which has hooked the catch 1027 which is mounted in the top 1032 of the rear release arm 1025. When the solenoid 1028 is remotely activated by the skier, the latch 1026 is pulled off the catch 1027, and the front of the rear locking arm 1025 pops up U due to the force applied by spring 1016.

Figure 17:
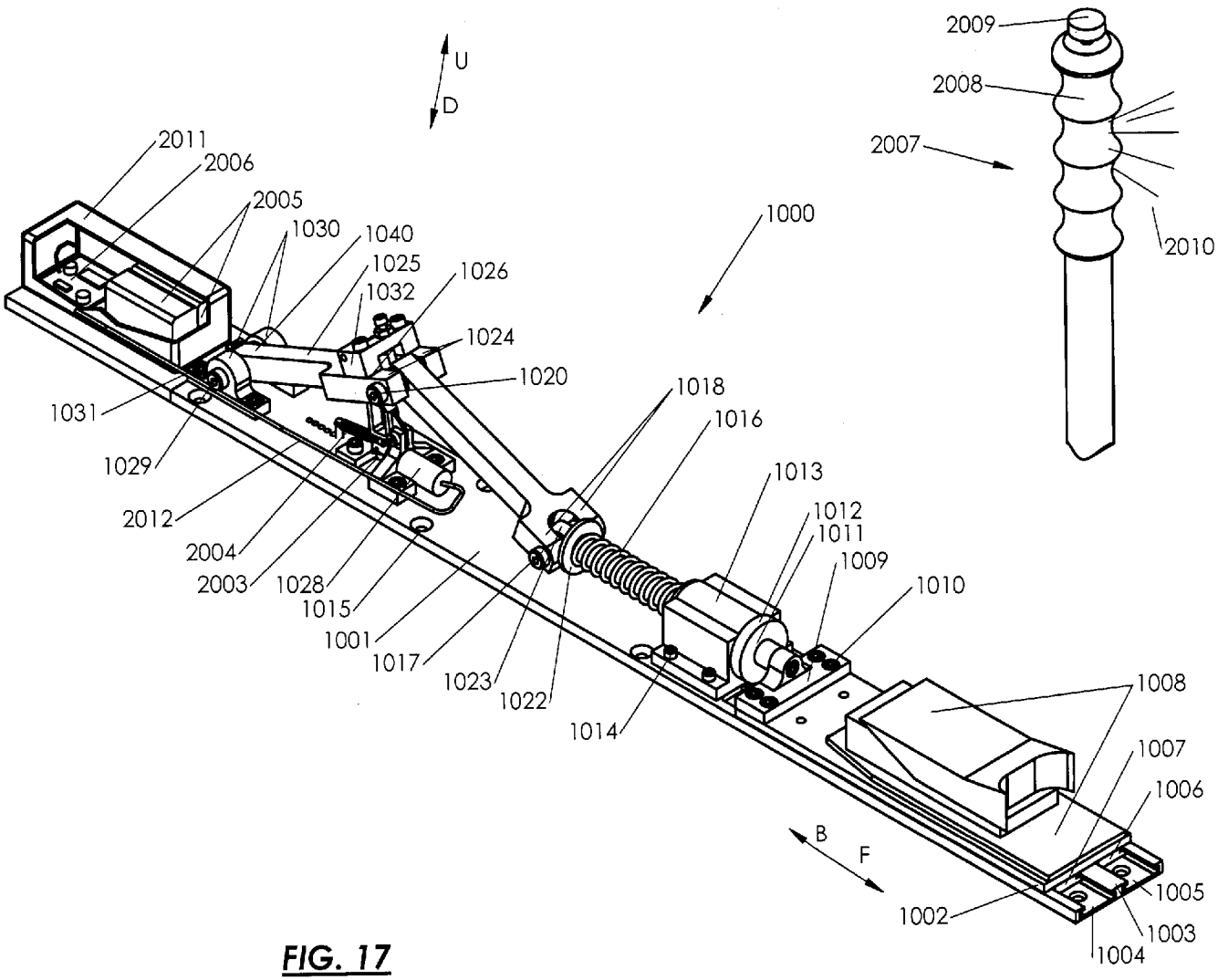
FIG. 17 is the same view as FIG. 16 with the actuator released.

Referring next to FIG. 17 the release mode is shown. The solenoid 1028 has been activated by the skier pushing the release button 2009 which causes a transmitter 2008 in the handle of the ski pole 2007 to send a signal 2010 (preferably a radio signal) to the receiver/controller 2006. The receiver/controller 2006 powers the solenoid 1028 to pull the bottom 2003 of the latch 1026 forward F. The latch 1026 pivots at pin 2499. The latch base 2000 supports the pin 2001. When the power is removed from the solenoid 1028, the spring 3116 returns the bottom 2003 of the latch 1026 backward B, thereby getting the latch 1026 in the ready position to engage the catch 1027 when the skier steps on the top 1032. The battery pack 2005 powers the solenoid 1028 and the receiver/controller 2006. The wire 2012 carries power to the solenoid 1028.

Figure 18:
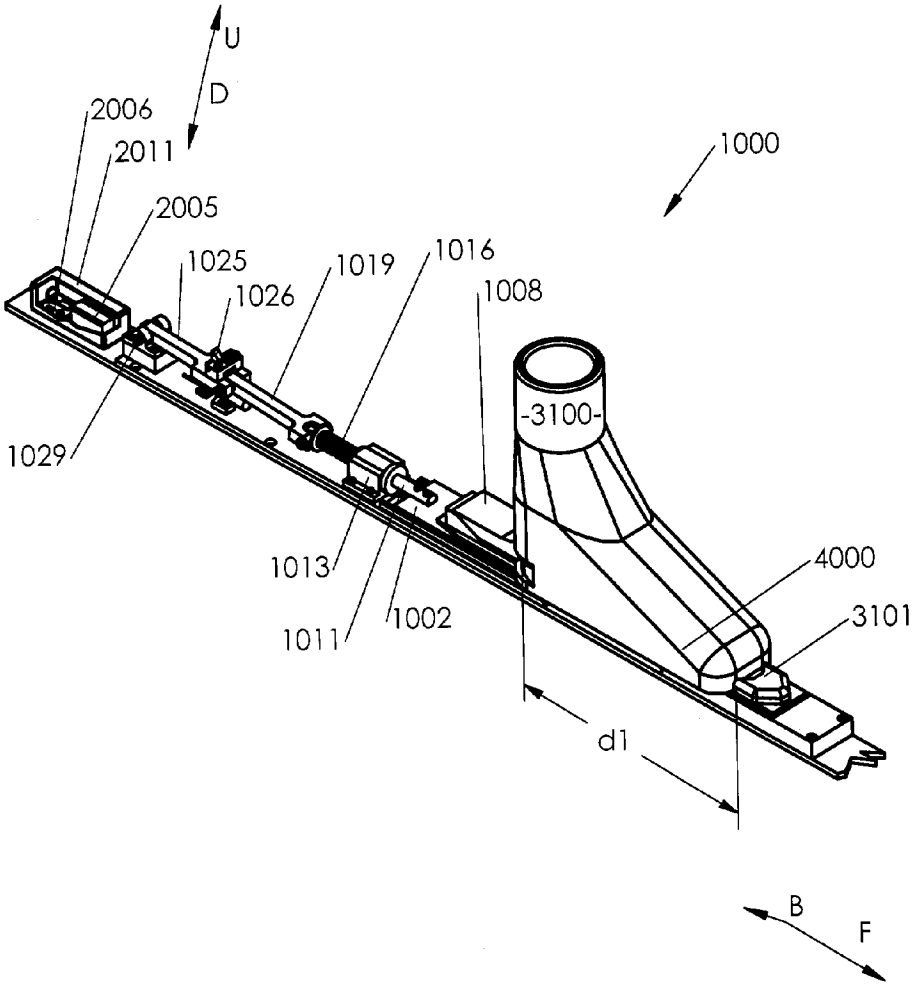
FIG. 18 is a top perspective view of a ski boot ready to ski in the cocked emergency backward release binding of FIG. 16.

Referring next to FIG. 18 the ski 4000 is equipped with a prior art step in binding heel member 1008 and toe member 3101. The ski boot 3100 has a length d1 for which the binding members 1008, 3101 have been adjusted to accommodate for proper release.

Figure 19:
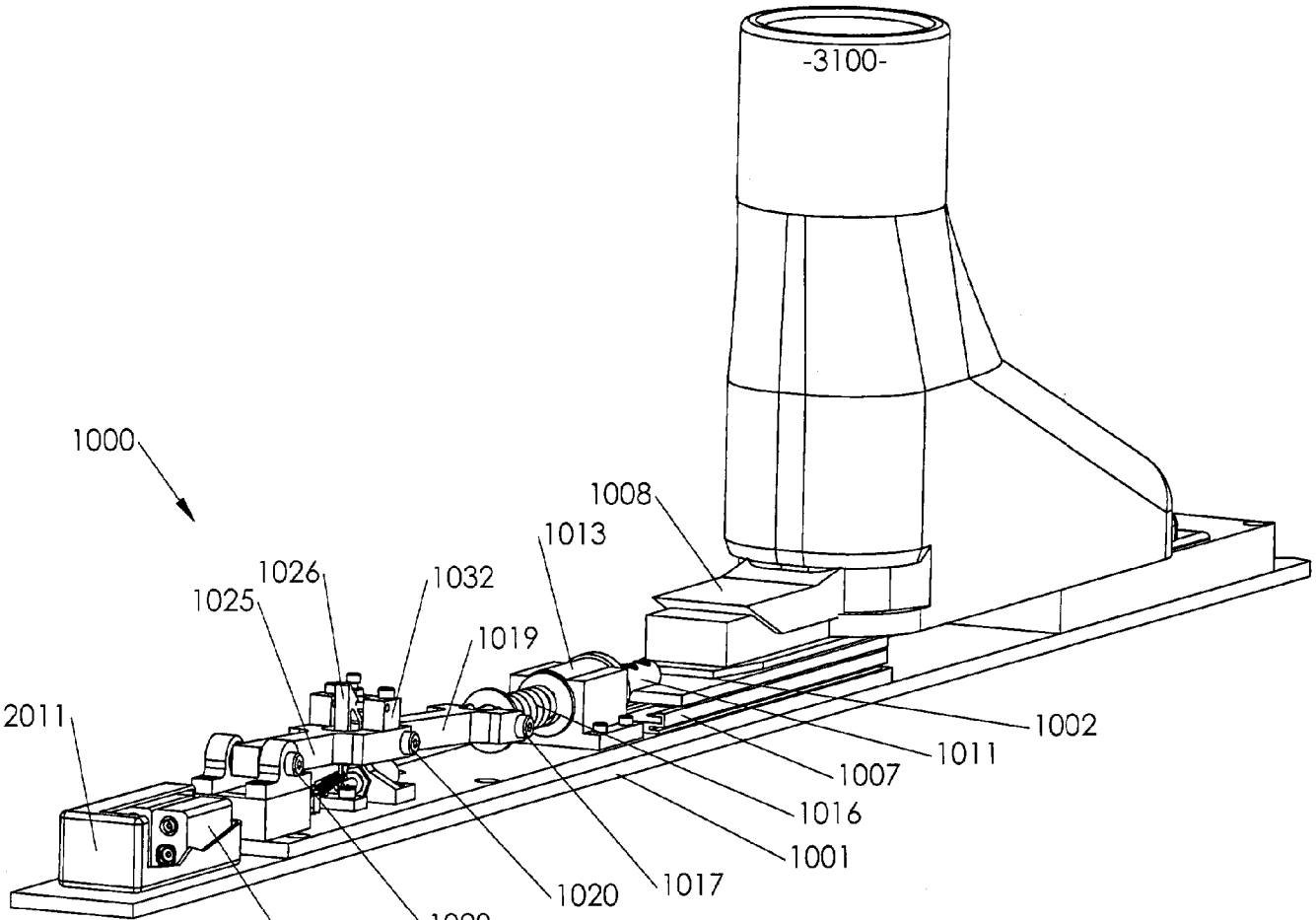
FIG. 19 is a rear perspective view of the ski boot ready to ski in the cocked emergency backward release binding of FIG. 16.

Referring next to FIG. 19 emergency backward release binding 1000 is in the ski mode.

Figure 20:
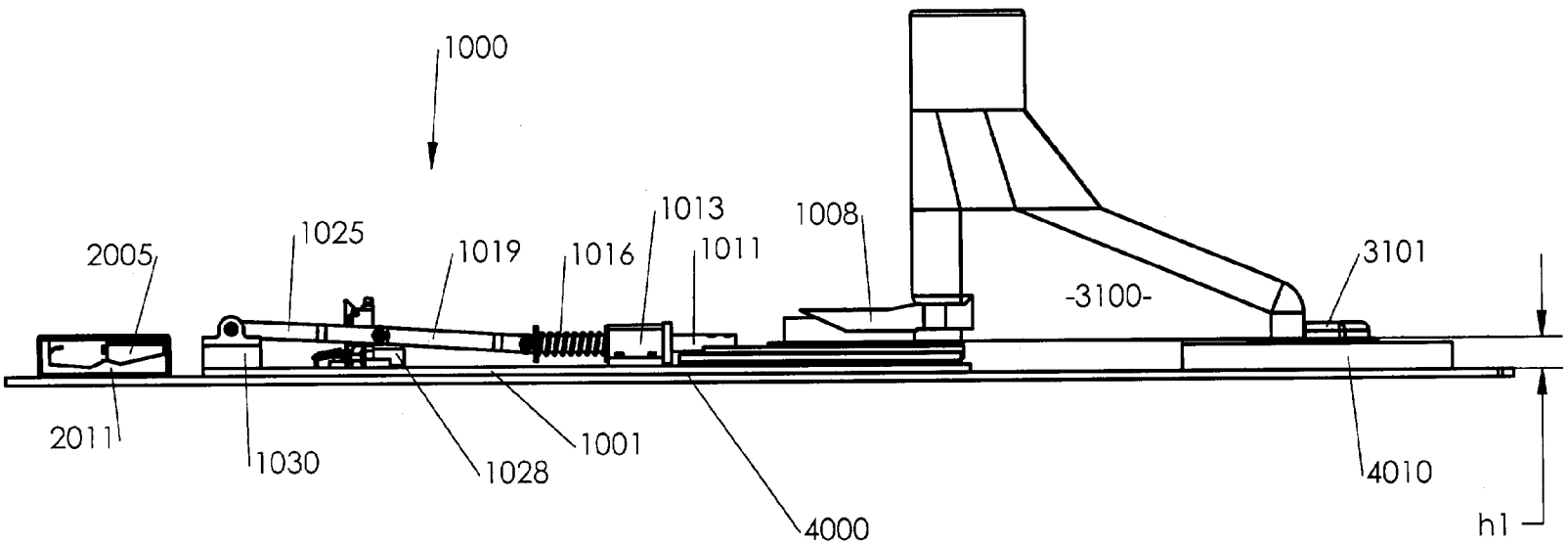
FIG. 20 is a plan view of the skier's right side showing the ski boot ready to ski in the cocked emergency backward release binding of FIG. 16.

Referring next to FIG. 20 it can be seen that the emergency backward release binding 1000 raises the boot 3100 a height h1 above the ski 4000. Therefore, a compensating plate 4010 must be installed under the toe member 3101 to keep the boot 3100 level. An equivalent system (not shown) would install the track 1002 under the toe member 3101, and mount the compensating plate 4010 under the heel member 1008.

Figure 21:
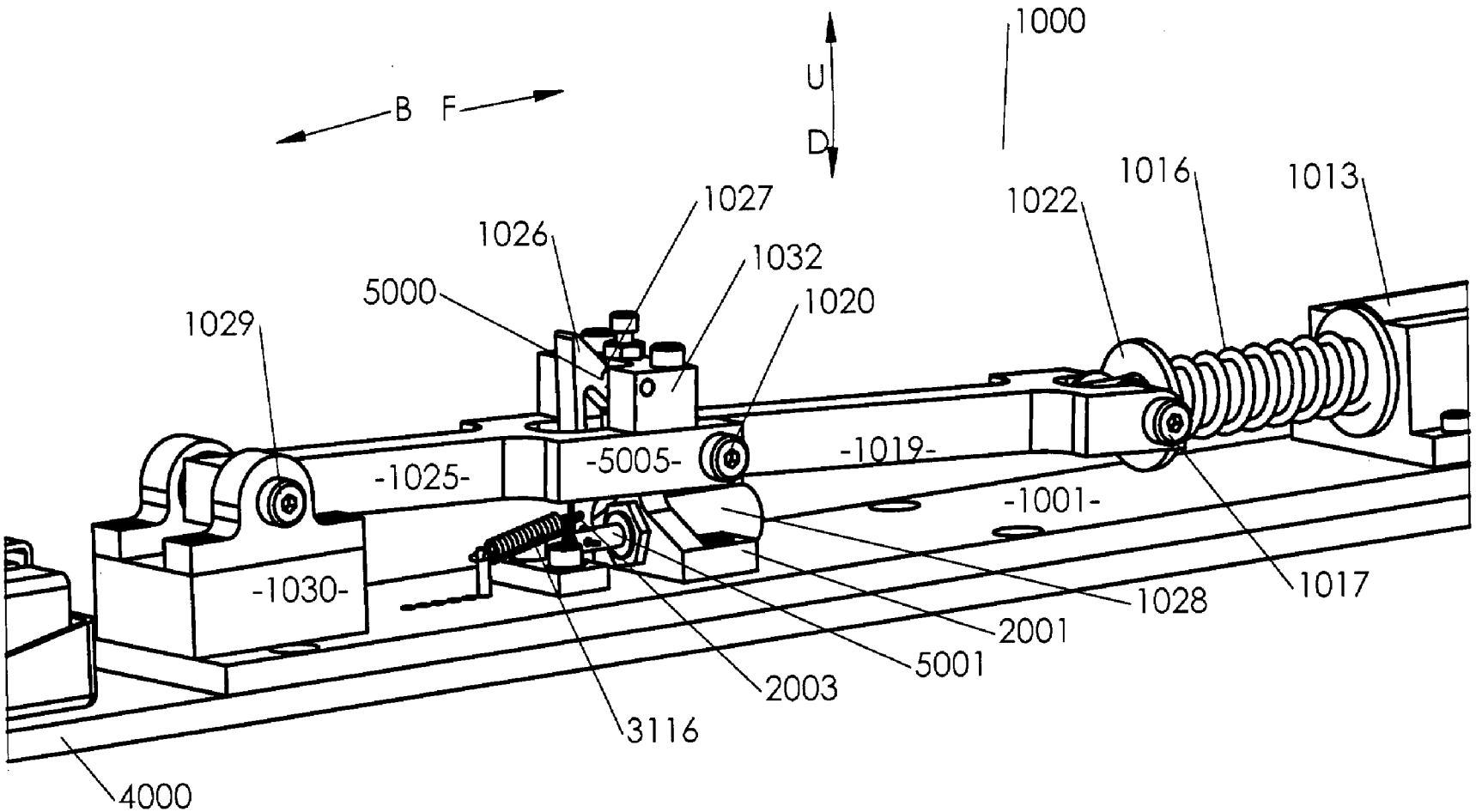
FIG. 21 is a close up perspective view of the release hinge assembly.

Referring next to FIG. 21 the latch 1026 is seen to have a locking detent 5000 which locks the catch 1027 down in the skiing mode as shown. The return spring 3116 maintains the bottom 2003 of the latch 1026 backward as shown. When the solenoid piston 5001 is pulled forward F by powering the solenoid 1028, the bottom 2003 is pulled forward F, the locking detent is pulled backward B, thereby releasing the catch 1027. At this point the forward locking arm 1019 forces the rear locking arm front end 5005 upward.

Figure 22:
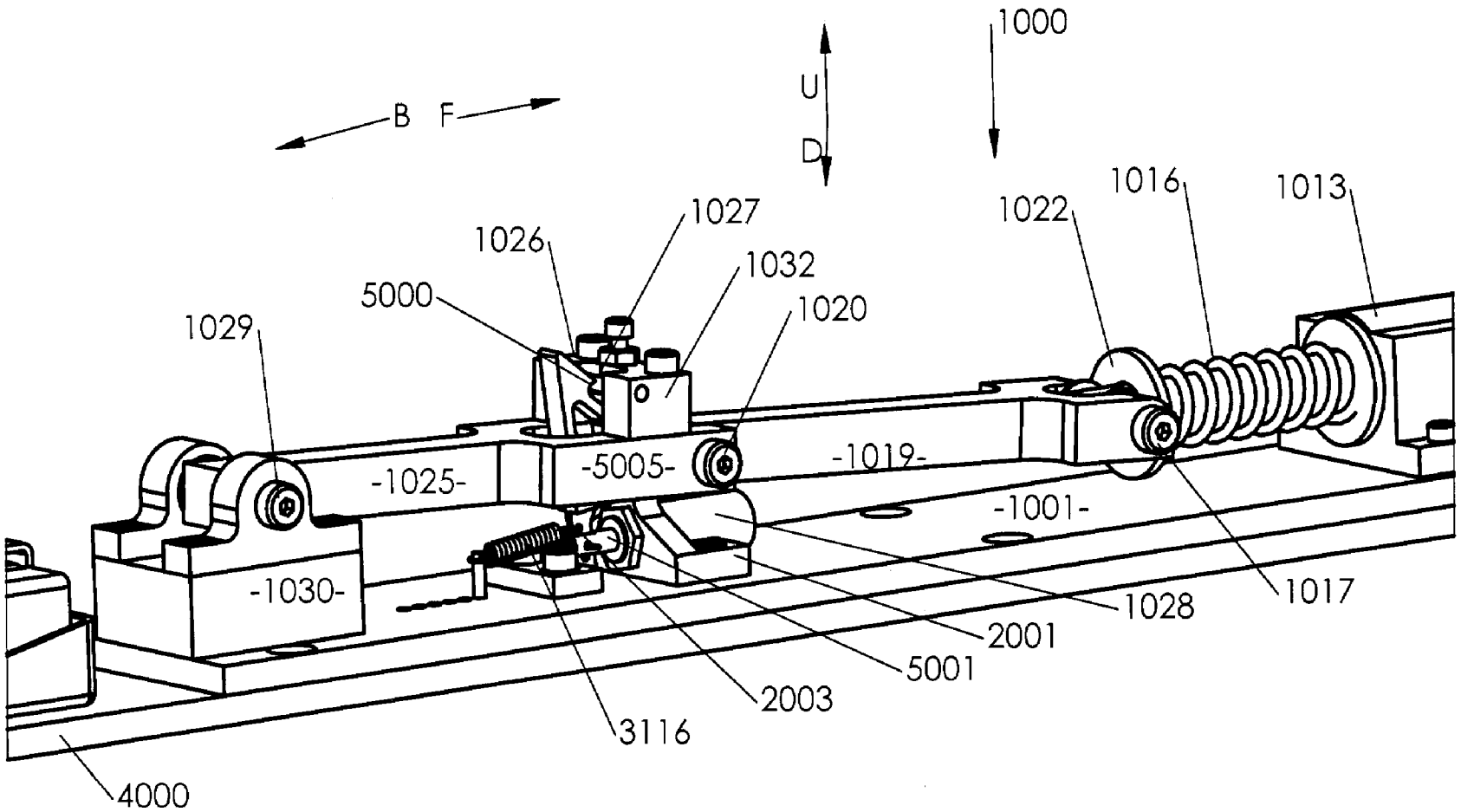
FIG. 22 is a skier's right side perspective view of the release hinge assembly with the trigger released.
Figure 26:
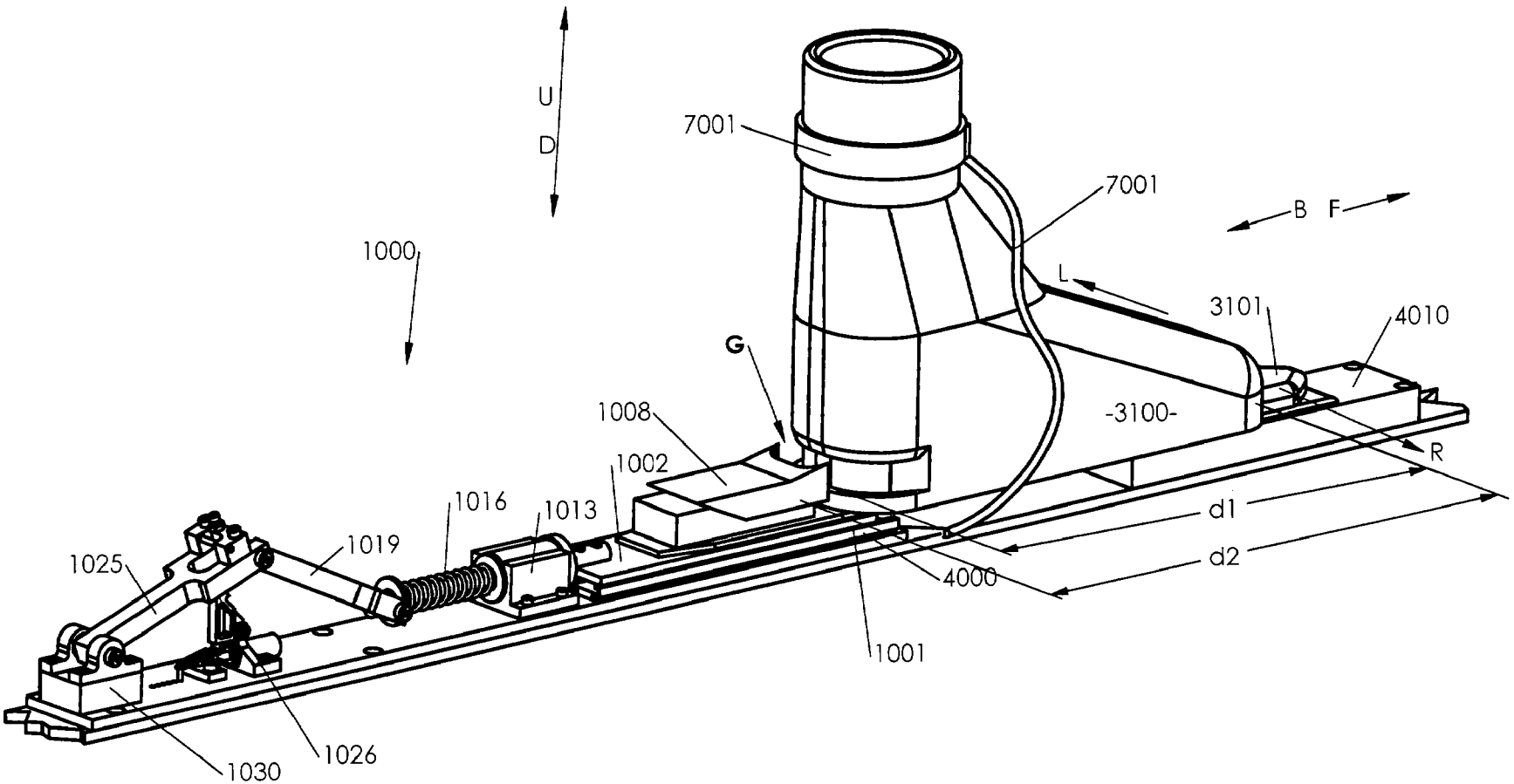
FIG. 26 is a skier's right side perspective view of the released emergency backward release binding showing the boot about to leave the ski.

Referring next to FIG. 22 the solenoid 1028 piston 5001 has been pushed backward B. The spring 1016 is about to push the forward locking arm 1019 backward B. This will cause the actuating piston 1011 to move backward B which in turn causes the track 1002 to move backward B. The result of this action is shown in FIG. 26 where the distance from the rear binding member 1008 to the toe binding member 3101 has increased to distance d2. The distance d2–d1 is about one quarter inch. However, design choice can enlarge this distance to about an inch.

Figure 23:
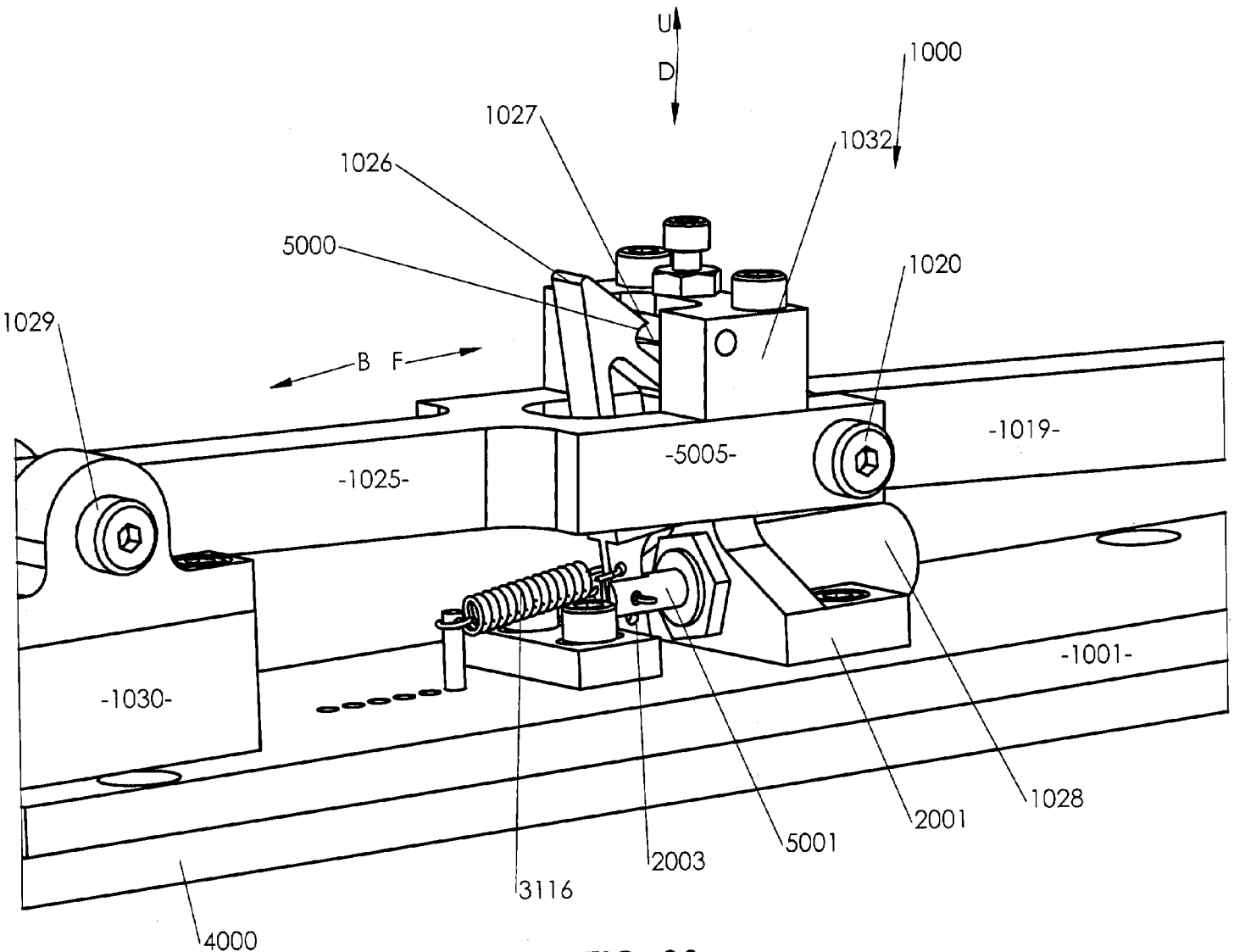
FIG. 23 is a close up view of the trigger released as shown in FIG. 22.

Referring next to FIG. 23 a close up view of the latch 1026 in the release position with the locking detent 5000 backward is shown.

Figure 24:
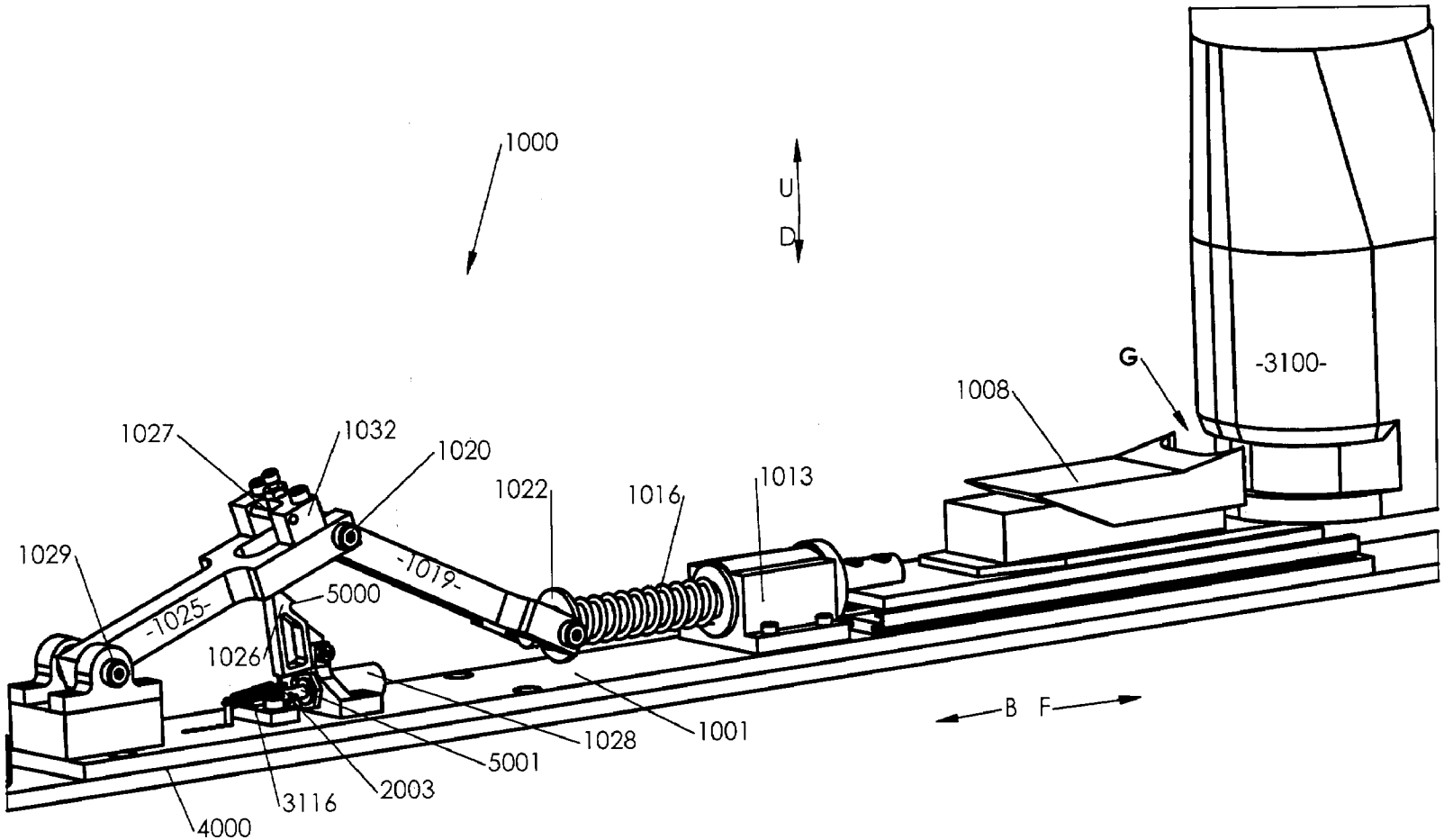
FIG. 24 is a rear perspective close up view of the trigger released and the hinge assembly in the released mode.

Referring next to FIG. 24 the plate 1002 is pulled backward, and a gap G now exists between the boot 3100 and the rear binding member 1008, so the skier can now fall backward as well as any direction and be released from the skis.

Figure 25:
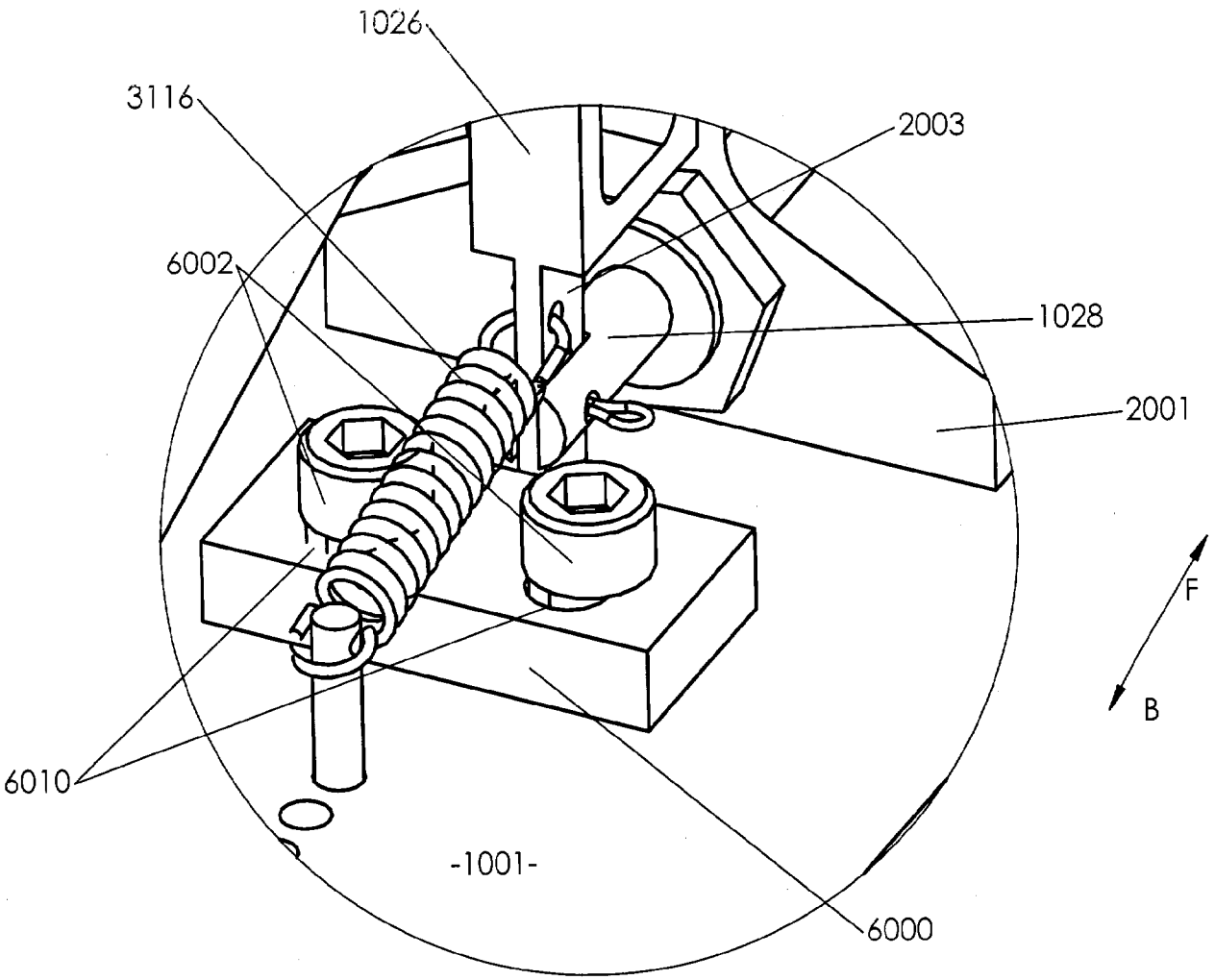
FIG. 25 is a close up view of the release assembly.

Referring next to FIG. 25, stop 6000 prevents the over travel of the bottom 2003 of latch 1026 in the B direction. Slots 6010 in stop 6000 permit the fine adjustment of the travel of bottom 2003 to a stop position. Screws 6002 fasten stop 6000 to base 1001 by passing through slots 6010 and into appropriately positioned holes (not shown) in base 1001. Travel of the bottom 2003 of latch 1026 in the F direction is limited by the stroke of solenoid 1028 piston 5001.

Referring next to FIG. 26 the released mode is shown. The heel of the boot 3100 is free. In operation a slight left L or right R force exists, thus the skier can fall backwards as his boot toe clears the toe binding member 3101. Additionally the spring 1016 exerts a forward force on the ski 4000 which also pushes the toe binding member 3101 clear of the front of the boot 3100. FIG. 26 also shows a safety tether 7001 secured around the boot 3100. The skier can use the clip 7002 to hook the eye 7000 which is screwed into the ski 4000. The skier may choose to do this before loading onto a chairlift to prevent an accidental release of his emergency backward release binding 1000 from dropping the ski 4000 off the chairlift.

Figure 27:
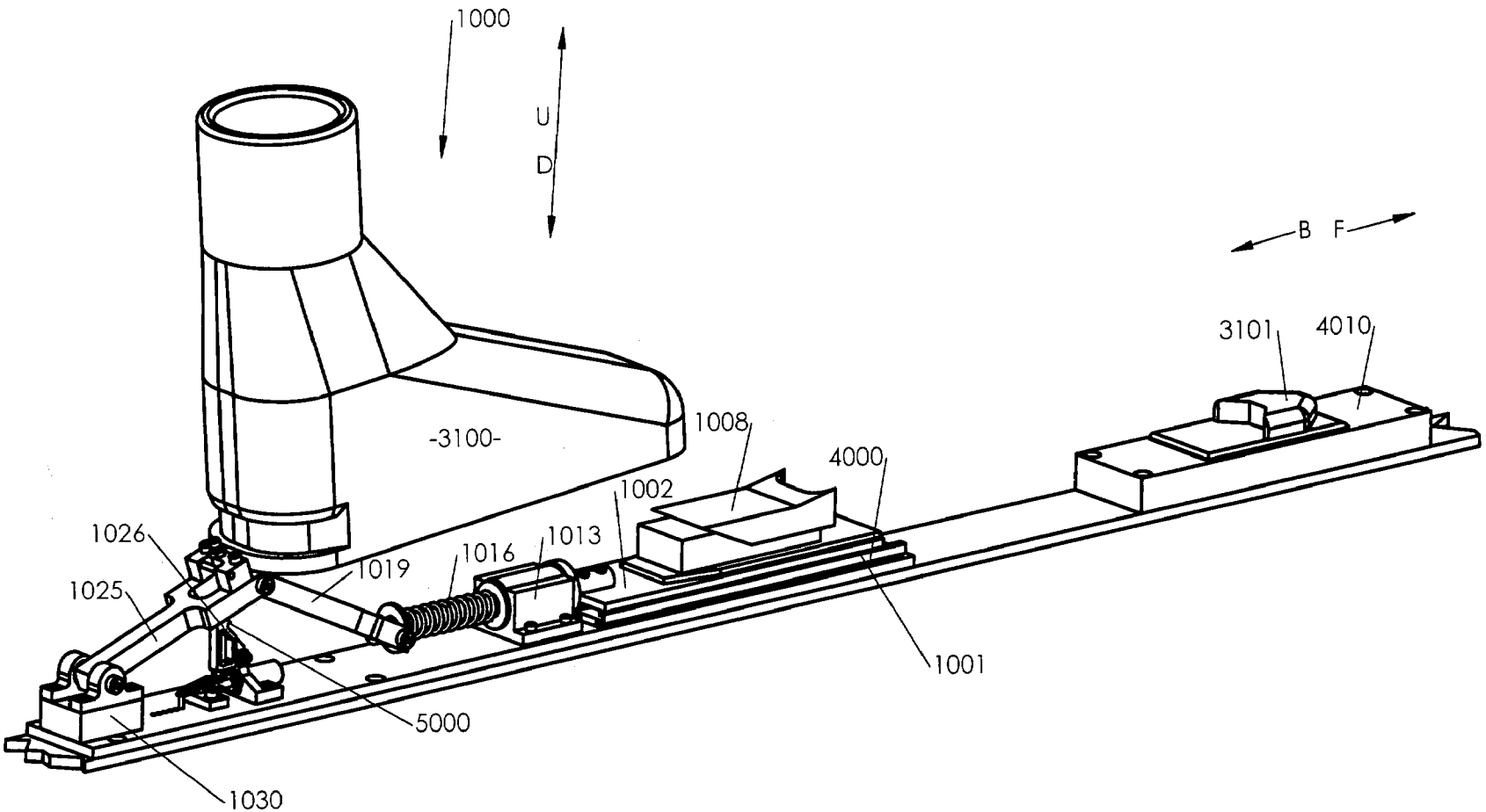
FIG. 27 is a skier's right side perspective view of the released emergency backward release binding showing the boot cocking the actuator.

Referring next to FIG. 27 the skier is stepping on the pivot pin 1020, or anywhere on the juncture area between the front lock arm 1019 and the rear lock arm 1025, including the top 1032. The skier's weight compresses the spring 1016 and locks the catch 1027 into the detent 5000. Thus, the skier has to add this step down maneuver to the prior art step down maneuver for each ski needed to cock the heel member 1008 for each ski.

Figure 28:
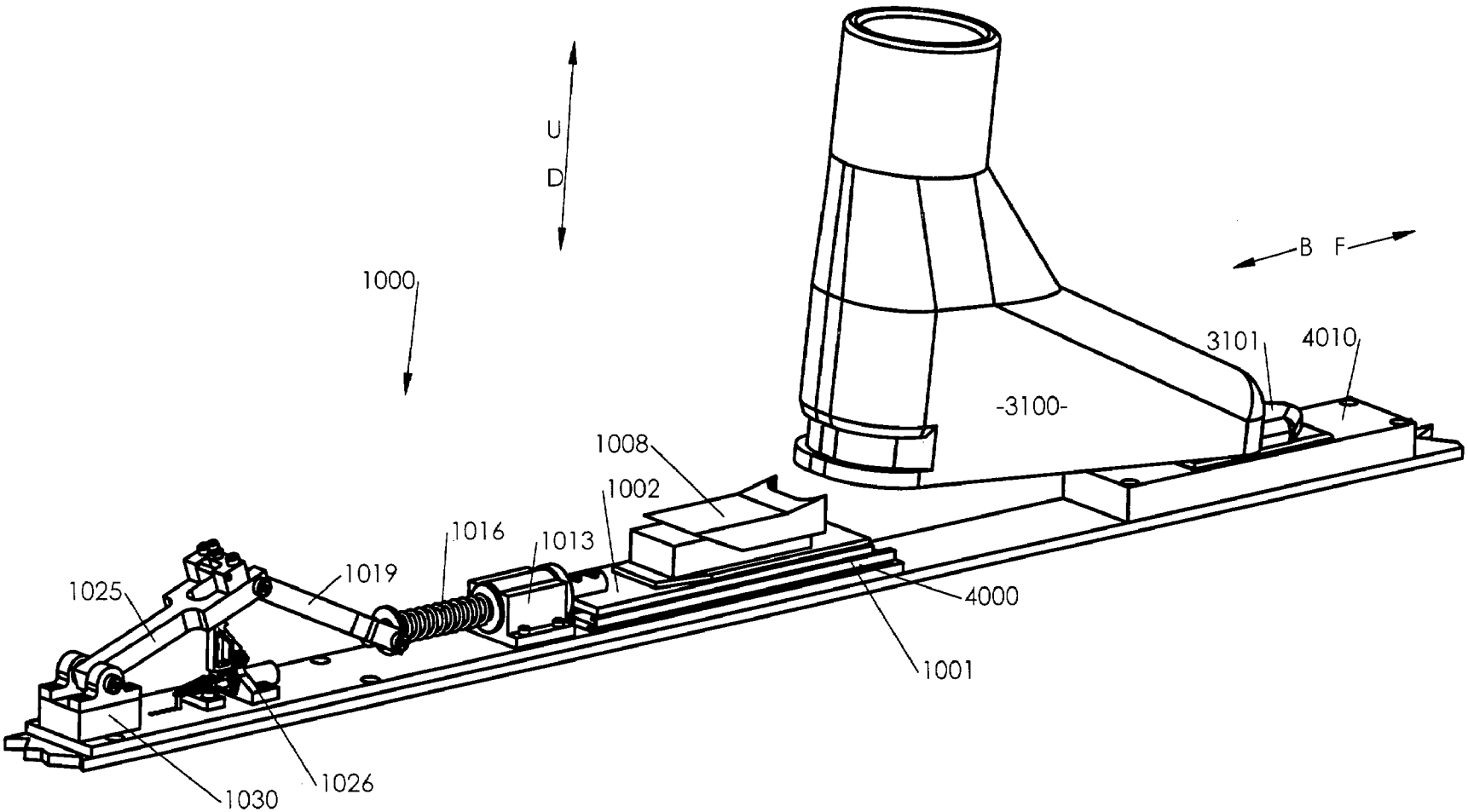
FIG. 28 is a skier's right side perspective view of a boot leaving the released emergency backward release binding.

Referring next to FIG. 28 the skier has released the emergency backward release binding 1000 and is stepping out of the skis at the lodge, or for an emergency stop, or for release when upside-down in a tree hole or when twisted after a fall, or for a military attack move enabling a soldier to fire a weapon while jumping out of his skis.

Figure 29:
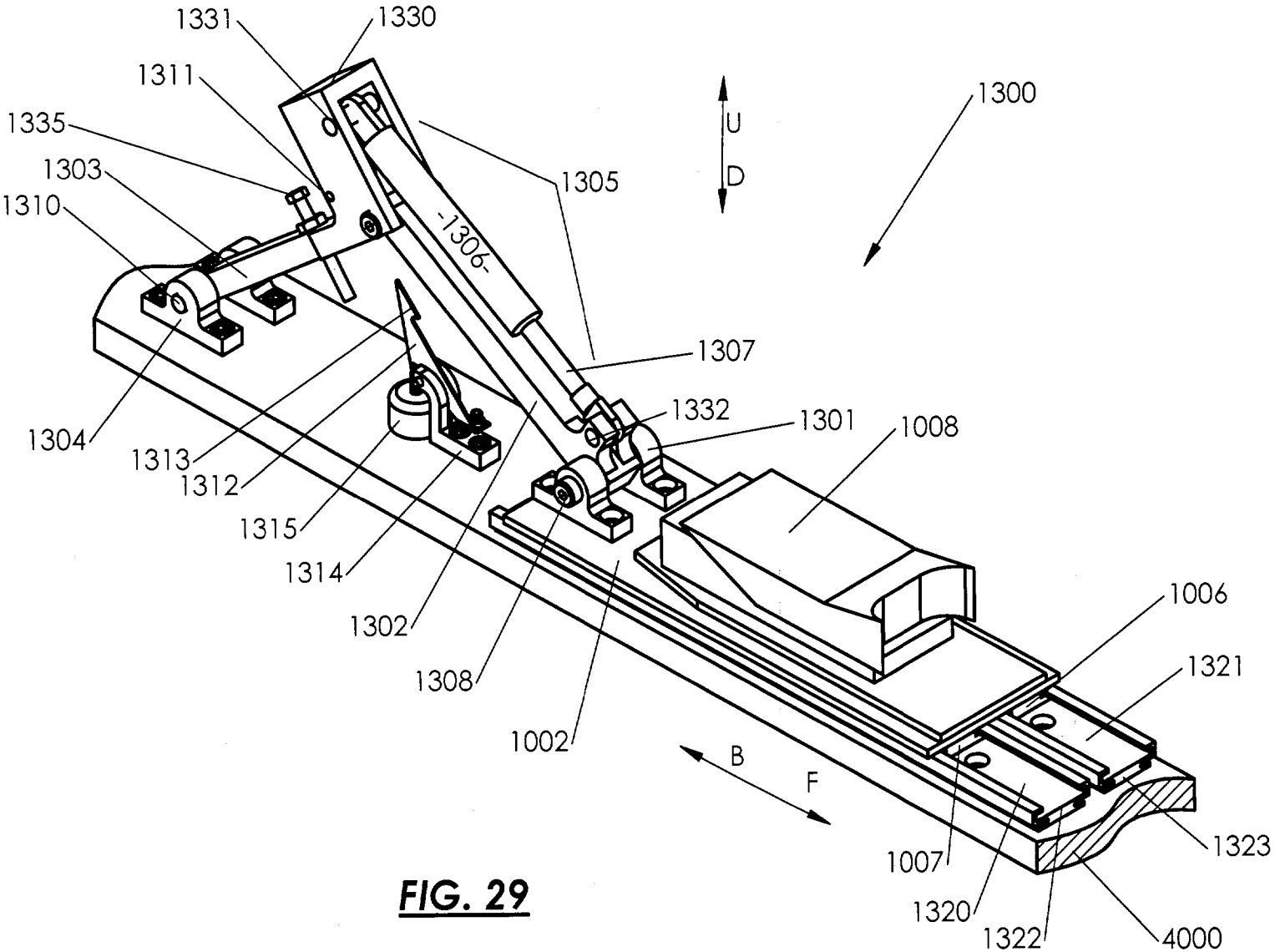
FIG. 29 is a front perspective view of an alternate embodiment gas piston version of the emergency backward release binding in the released mode.

Referring next to FIG. 29 an alternate embodiment emergency backward release ski binding 1300 using a gas piston assembly 1305 to pull the track 1002 backwards B. This embodiment is functionally equivalent to the FIG. 17, 1000 embodiment. The track 1002 moves backwards B in the same way for the release mode, which is shown.

This figure also shows the alternate embodiment rails 1322, 1323 which screw directly into the ski 4000. No base plate 1001 is needed. This rail embodiment could be used in the FIG. 16, 1000 embodiment. Members that mounted to the base plate 1001 would mount instead to the ski 4000.

The track 1002 has a rear anchor 1301 with a pivot pin 1308 pivotally supporting the forward back arm 1302. The pivot pin 1309 pivotally supports the rear lock arm 1303 with the forward lock arm 1302. An anchor 1301 has a pivot pin 1308 to support the forward end of the front lock arm 1302. An anchor 1304 has a pivot pin 1310 supporting the rear of the rear lock arm 1303. The front of the rear lock arm 1303 has a housing 1330 to support the pivot pin 1309 as well as to support the gas chamber 1306 via the pivot pin 1331. The forward end of the piston 1307 is attached to the forward end of the forward back arm 1302 with a pivot pin 1332. The piston 1307 extends from the gas chamber 1306 due to gas pressure. When changing from the ski position to the release position the latch 1313 has been released from the housing 1330 which has a catch 1311 for the detent 1313.

Figure 30:
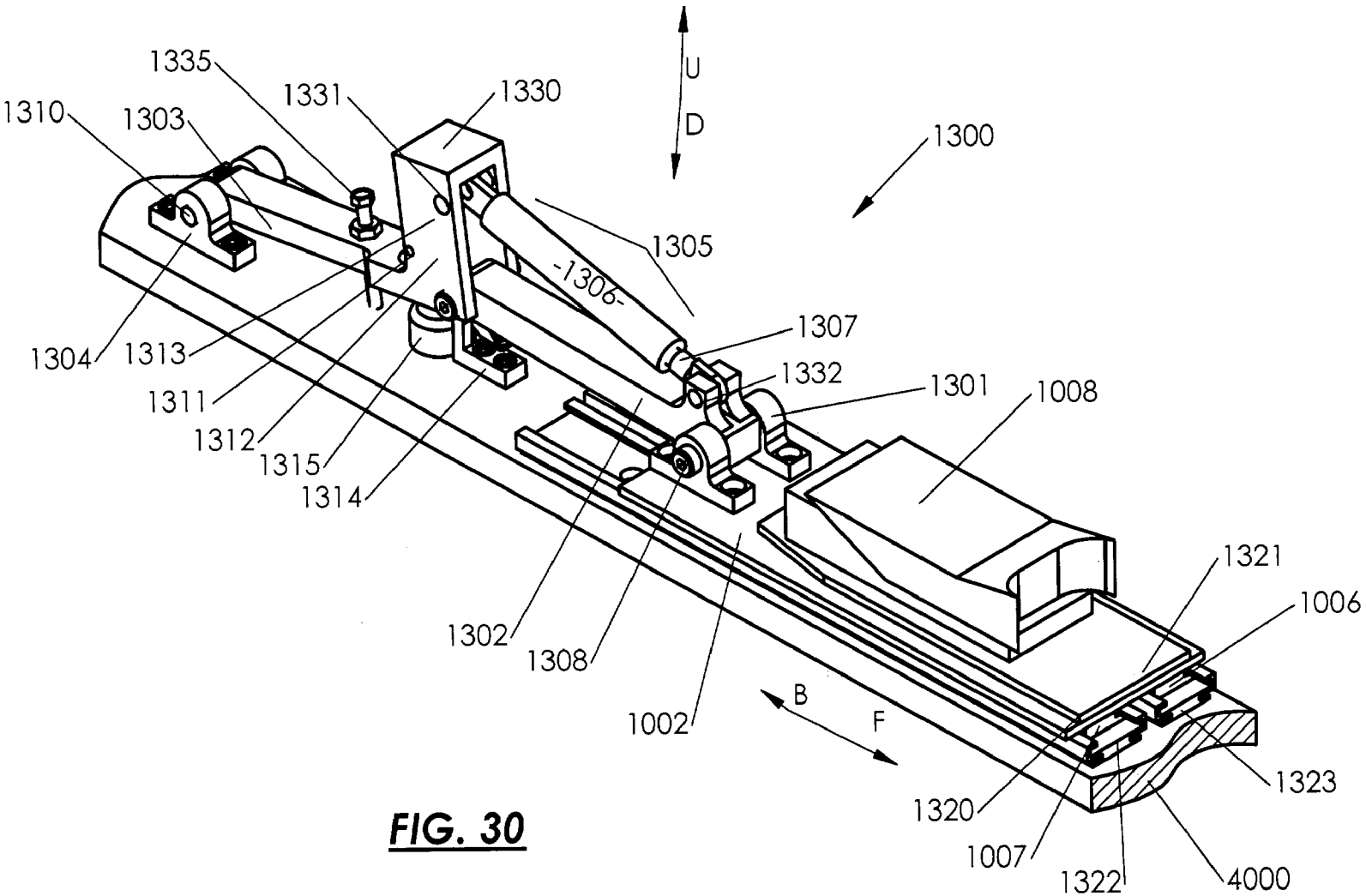
FIG. 30 is the same view as FIG. 29 with the binding cocked.

The solenoid 1315 has an actuator 1317 which pulls the detent 1313 from the catch 1311 when the solenoid 1315 is powered by the receiver/controller (as shown in FIG. 28). A base 1314 pivotally supports the latch 1313 via pivot pin 1316. The adjustment bolt 1335 prevents an over-depression of the rear lock arm 1303 when the skier steps on the housing 1330 depressing it downward D to cock the piston assembly 1305 into the ski mode. As shown in FIG. 30 the skier has stepped onto the housing 1330, thereby compressing air in the gas chamber 1306. The compressed air forces the piston 1307 out of the chamber 1306 when the latch 1312 is released via the solenoid 1315. The adjustment bolt 1335 is in contact with the ski 4000. The heel binding member 1008 is ready to accept a ski boot.

Figure 31:
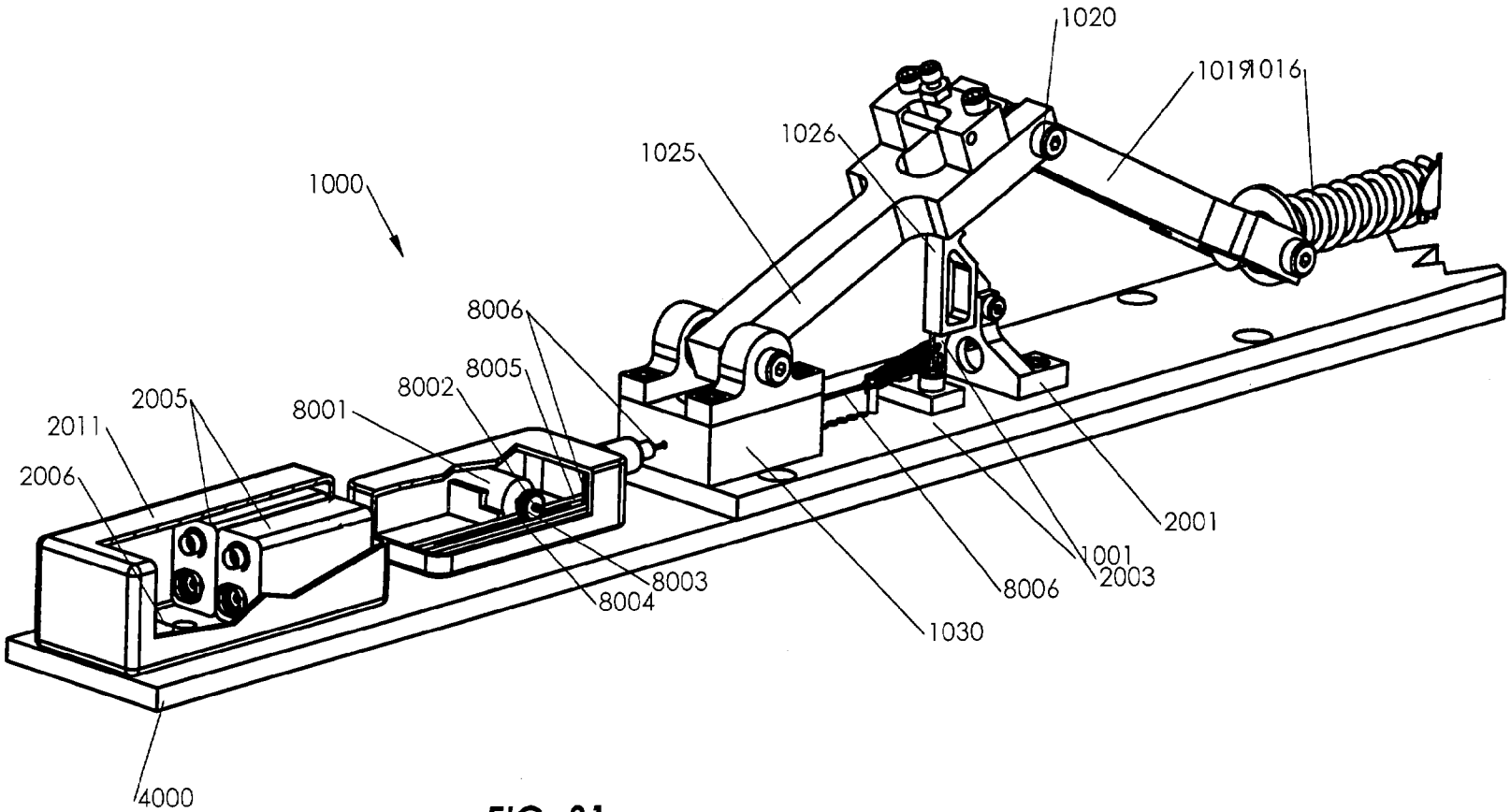
FIG. 31 is a back perspective view of an alternate embodiment rack and pinion operated latch shown in the released mode.
Figure 32:
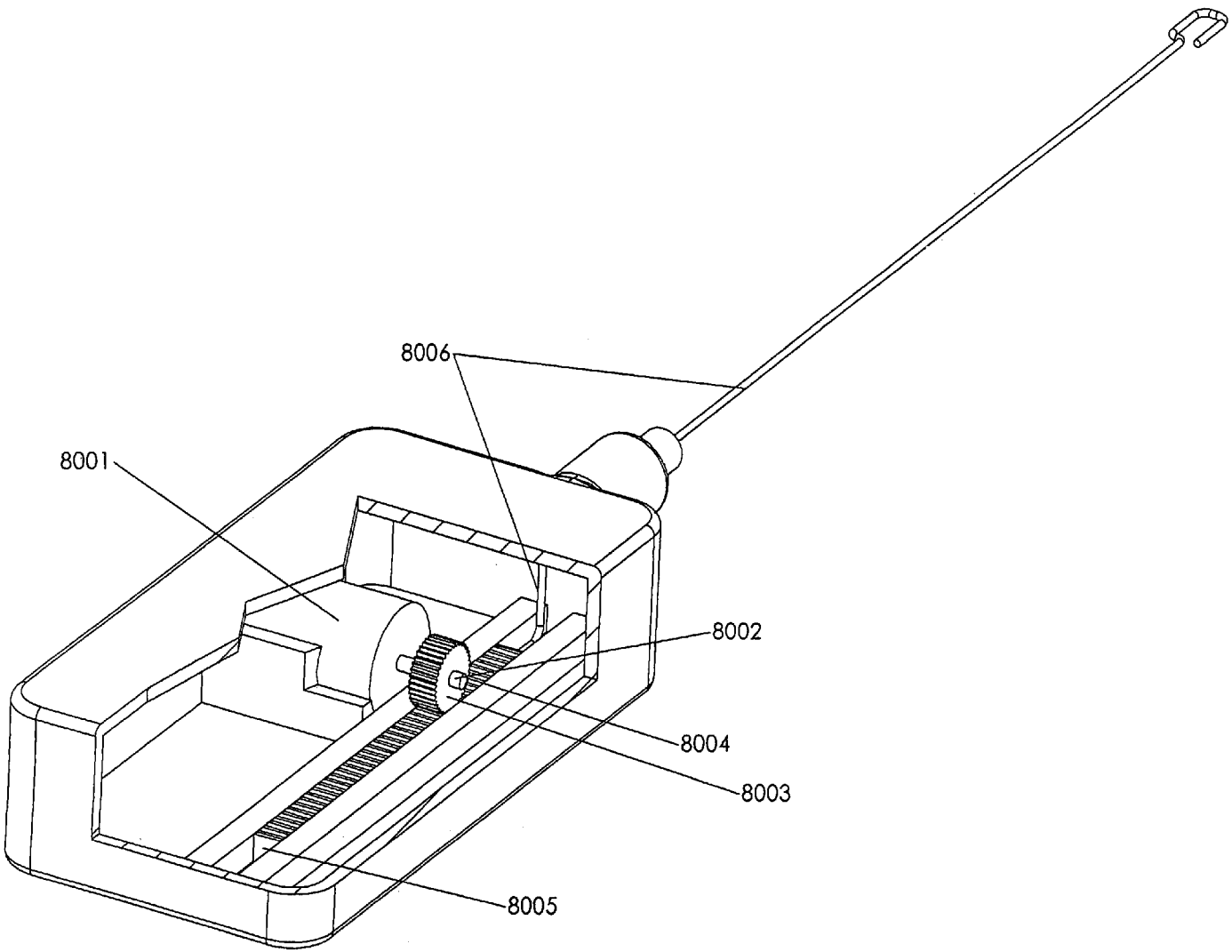
FIG. 32 is a back perspective cut away view showing rack and pinion.

Referring next to FIGS. 31, 32 receiver 2006 activates motor 8001. Mounted on the rotating shaft 8002 of motor 8001 is a pinion gear 8003 that rotates in unison with shaft 8002. The rotation of pinion gear 8003 engages the teeth 8004 of rack 8005 that is free to slide longitudinally in directions B and F as pinion gear 8003 rotates clockwise and counter clockwise respectively. The F and B movement of rack 8005 is transferred to the bottom of latch 2003 via ridged wire 8006.

Equivalents to all the above described inventions include all combinations of all embodiments. The rails 1322, 1323 can be used with the spring 1016 embodiment shown in FIG. 17. The piston assembly 1305 embodiment of FIG. 4 can be used with the base plate 1001 embodiment of FIG. 17. All embodiments could be mounted to the toe binding member instead of the heel binding member. Pivot pins are equivalent to any pivot joint. A solenoid is equivalent to any linear actuator such as a linear motor, or rack and pinion.

Although the present invention has been described with reference to preferred embodiments, numerous modifications and variations can be made and still the result will come within the scope of the invention. No limitation with respect to the specific embodiments disclosed herein is intended or should be inferred.

We claim:

1. A remote controlled ski binding release system comprising:

a sliding plate adapted to fasten to a ski;

said sliding plate adapted to receive a ski binding member and slide away from an opposing ski binding member in a remote control release mode;

a lock arm assembly having a movable end connected to the sliding plate;

said lock arm assembly having a pair of pivotally connected arms which have a central pivot joint which moves away from a ski surface in the remote control release mode;

said lock arm assembly further comprising a release assembly located under the central pivot joint of the pair of pivotally connected arms;

wherein a lock arm assembly length is shortened in the remote control release mode and lengthened in a ski mode;

a stored energy assembly means functioning to move the lock arm assembly to the remote control release mode from the ski mode, and functioning to be cocked in a single step by a push on the central pivot joint thereby adding energy to the stored energy assembly means;

a receiver/controller adapted to mount onto the ski and receive a remote signal to release the stored energy from the stored energy assembly means, thereby moving the lock arm assembly from the ski mode to the remote control release mode;

wherein the release assembly further comprises a latch which releasably connects to a catch on a member of the pair of pivotally connected arms; and wherein an automatic release of the ski binding release system maintains a constant mounting distance between a toe and a heel binding member.

2. The release system of claim 1, wherein the stored energy assembly means further comprises a spring.

3. The release system of claim 1, wherein the stored energy assembly means further comprises a gas piston assembly.

4. The release system of claim 1 further comprising a remote transmitter controllable by a skier to provide the remote signal.

5. The release system of claim 4, wherein the remote transmitter is located in a ski pole having an actuator switch.

6. The release system of claim 4, wherein the receiver/controller further comprises an electronically activated noise maker.

7. The release system of claim 6, wherein the noise maker is a chirper chip.

8. The release system of claim 1, wherein a track is adapted to fasten to the ski by means of a base plate, said track supporting the sliding plate.

9. The release system of claim 1, wherein the ski binding member which slides away is a heel binding, and the opposing ski binding member is a toe binding.

10. The release system of claim 1, wherein the stored energy assembly means further comprises a rack and pinion assembly.

11. The release system of claim 1, wherein the release assembly further comprises a locking detent which engages the catch in the ski mode via a second spring connected between the latch and a base of the release assembly.

12. The release system of claim 11, wherein the release assembly further comprises a solenoid connected to the latch via a connection subsystem whereby the solenoid may move the latch via the connection subsystem to a position such that the locking detent does not engage the catch in the remote control release mode.

* * * * *